US005770533A

United States Patent [19]

Franchi

[11] Patent Number: 5,770,533

[45] Date of Patent: Jun. 23, 1998

[54] OPEN ARCHITECTURE CASINO OPERATING SYSTEM

[76] Inventor: John Franco Franchi, 601 Pennsylvania Ave., N.W. Suite 700 North Building, Washington, D.C. 20004

[21] Appl. No.: 235,988

[22] Filed: May 2, 1994

[51] Int. Cl.[6] ..... A63F 9/24

[52] U.S. Cl. ..... 463/42; 463/16; 463/20; 463/25

[58] Field of Search ..... 273/85 CP, 296, 273/292, 142 E, 146, 138 A, 143 R, 309; 463/25, 42, 16, 20, 29

[56] References Cited

U.S. PATENT DOCUMENTS

| | | | |
|---|---|---|---|
| 3,697,698 | 10/1972 | Oswald et al. | 370/110 |
| 3,766,452 | 10/1973 | Burpee et al. | 194/214 |
| 4,467,424 | 8/1984 | Hedges et al. | 273/138 A |
| 4,575,621 | 3/1986 | Dreifus | 235/380 |
| 4,644,368 | 2/1987 | Mutz | 346/33 D |
| 4,722,053 | 1/1988 | Dubno et al. | 364/401 |
| 4,764,666 | 8/1988 | Bergeron | 273/139 A |
| 4,814,589 | 3/1989 | Storch et al. | 235/375 |
| 4,815,741 | 3/1989 | Small | 273/138 A |
| 4,892,311 | 1/1990 | Zaitsu | 273/145 D |
| 4,906,005 | 3/1990 | Manabe | 273/138 A |
| 5,183,142 | 2/1993 | Latchinian et al. | 194/206 |
| 5,242,163 | 9/1993 | Fulton | 273/138 A |
| 5,277,424 | 1/1994 | Wilms | 273/138 A |
| 5,321,241 | 6/1994 | Craine . | |
| 5,374,061 | 12/1994 | Albrecht | 273/149 R |
| 5,377,994 | 1/1995 | Jones | 273/309 |
| 5,429,361 | 7/1995 | Raven et al. | 463/25 |

FOREIGN PATENT DOCUMENTS

| | | | |
|---|---|---|---|
| 2073447 | 10/1981 | United Kingdom | 273/143 R |

*Primary Examiner*—Jessica Harrison

[57] ABSTRACT

A casino operating system is disclosed for controlling the flow of funds and monitoring gambling activities in a casino or a gaming establishment utilizing a network of computers, including a central computer and individual game computers. Each player receives an encoded betting card from the cashier. At the games, each player position is equipped with a control panel including a card reader into which the betting card is inserted. The control panel also includes an electronic screen and keyboard. From the control panel, the player may place a bet and perform all options available to the player in the particular game. The system records the hands dealt to each player and the winner, and credits or debits the player's betting card accordingly. In an alternative embodiment, the casino operating system allows the players to use chips to place bets instead of the above-described betting card. The chips are marked or encoded so that they can be counted once final bets have been placed to determine the amount of each player's bet. In games requiring the placement of bets in certain positions on the gaming table, each player may be provided with a betting marker used to indicate the position of his bets on the table, a touch-sensitive screen maybe used whereby bets are placed by touching the desired position on the screen, or a two-way remote control console for placing bets. The casino operating system is an open architecture system adaptable to accommodate the differing needs of each casino.

50 Claims, 11 Drawing Sheets

OPEN ARCHITECTURE CASINO OPERATING SYSTEM

FIELD OF THE INVENTION

The present invention relates to an open architecture casino operating system for monitoring game play and controlling the flow of funds in a casino or gaming establishment, in which game play is monitored and the flow of funds is controlled by a hierarchical network of computers. The system is adaptable to accommodate the specific needs of individual casinos.

BACKGROUND OF THE INVENTION

Cheating is one of the largest problems faced by casinos today. Casinos spend millions of dollars each year on surveillance equipment, primarily visual surveillance equipment consisting of video cameras positioned at various angles above and around gambling tables. Current surveillance techniques also require the use of casino employees who monitor play at the tables and slot machines.

One of the most successful methods of cheating is "dealer skimming" in which a dealer makes an arrangement with one of the players across the table, thereby increasing that player's odds of winning. Such schemes are often accomplished by use of a pre-arranged system of signals between the dealer and player that are undetectable to video surveillance systems. For example, in the game of blackjack, the cards of all of the players are dealt face up while the dealer has one face-up card and one face-down card. The dealer signals the players indicating the value of the dealer's face-down card. In this way, the player's odds of winning could be significantly increased because the player knows for certain the value of the dealer's cards and can place bets accordingly. Further, in casinos where the dealer is not allowed to look at the face-down card, for example, the dealer may pay out to the player more than the player actually wins or pay the player even though the player actually lost. The speed with which the cards are dealt and the chips distributed is such that visual surveillance is often unsuccessful in identifying dealer mistakes, both intentional and unintentional. In fact, the owners of a number of casinos have indicated that their profits would be significantly higher if blackjack dealers were removed from the game all together.

In addition to the losses created by cheating of the players and the dealers in casinos, casino owners are also faced with theft. Large quantities of money change hands in casinos, and both employees and players carry large amounts of cash. Therefore, casino owners must provide adequate security to ensure that their guests and employees are protected. This often requires a large staff of security employees.

Another significant cost to casinos and other gambling establishments is that of staffing the casino games with trustworthy and trained employees to run the games, distribute chips, and perform other game-related functions. For example, in the game of roulette, a table for ten players may require as many as seven employees. With reference to Prior Art FIG. 1, there are ten players (P) positioned at the table 101. To run the game, the casino provides two employees (B) to collect and distribute the chips won and lost in the game; two cashiers (C) to provide players with additional chips in exchange for cash; two "pit bosses" (PB) to monitor the play and the other employees, and to take the cash from the cashiers (C) to the casino bank periodically; and one employee (O) to operate the roulette wheel 102. This type of labor-intensive operation is expensive. It is also very difficult to monitor to ensure that the casino is receiving all of the money actually taken in by the employees.

The problems described above indicate the great potential for cheating and the lack of accountability for money transactions that exists in casinos and other gambling establishments using current surveillance techniques. This lack of accountability not only cuts into casino profits, but also is a major factor in many states' decisions to severely restrict legalized gambling activities. In essence, the potential for money disappearing is too great, even with the most elaborate visual surveillance techniques.

OBJECTS OF THE INVENTION

Therefore it is an object of the present invention to provide a surveillance system for gambling which eliminates cheating problems including dealer skimming.

It is a further object of the present invention to provide a surveillance system which will increase the security of both the employees of the casino and the actual guests.

It is a further object of the present invention to provide a surveillance system that will enable a reliable accounting of the flow of funds in casinos.

It is a further object of the present invention to provide a system which allows the players to establish a line of credit and use that line of credit in a number of different games without the use of cash or chips.

It is a further object of the present invention to provide an open architecture or modular system adaptable to accommodate the specific needs of individual casinos by choosing from among available system components with a variety of options.

It is a further object of the present invention to achieve the above objects while minimizing the number of employees and, hence, the operating costs of the casino.

SUMMARY OF THE INVENTION

According to the present invention, a casino operating system is disclosed for controlling the flow of funds and monitoring gambling activities in a casino or a gaming establishment utilizing a network of computers. According to one preferred embodiment, each player receives an encoded betting card from the cashier, in place of gaming chips or cash, and may return the card to the cashier to receive cash, increase their credit, or directly deposit the betting card cash balance into a bank account. The betting card preferably contains a secure microprocessor and memory for preserving information including identification of the player, the cash balance of the player, and an identification code known to the player. This information prevents others from having access to the betting card. In the alternative, the card must at least comprise a secure read/write memory which may be a magnetic strip, or provide electrical or optic write-in, read-out or related capability.

At the gaming table, each player position is equipped with a control panel including a card reader into which the betting card is inserted. The control panel also includes a data output device, for example, an electronic screen and a data input device, for example a touch screen or a keyboard. From the control panel, the player may place a bet and perform all options available to the player in the particular game. The control panel also displays player information, such as current betting card balance, winnings from the last round, current bets, and playing cards dealt, as well as optional service features, for example, via the electronic screen. The player's betting card is credited or debited accordingly after each round.

A gaming apparatus is provided for each gambling game in the casino to monitor the play of the game. For example, in games using playing cards, such as blackjack, an encoded marker is placed on the face of each playing card. A scanning device is mounted on the playing card shoe so that each card drawn from the shoe is registered by the computer. The computer records the hands dealt to each player and the winner, and credits or debits the player's betting card accordingly.

In an alternative embodiment, a system according to the present invention allows the players to use chips to place bets instead of the above-described betting card. An integrated circuit (IC) chip is inserted into the betting chips. These smart chips transmit an identification signal enabling the value of the chips to be counted by a remote sensor once final bets have been placed to determine the amount of each player's bet.

In games that require the placement of bets in certain positions on the gaming table, each player may be provided with a personal betting marker containing an IC chip, such as a wand. The player uses the betting marker to indicate the positions on the table on which the player wants to bet. A sensor within the table senses the player's identity transmitted by the IC chip in the betting marker and records the bets accordingly.

In an alternative embodiment, the screen of each player's control panel displays a miniaturized betting table layout and comprises a touch-sensitive screen, such that the player may place a bet by touching the desired position on the screen, or a miniaturized version of the betting table may also be provided with push buttons located at each of the possible betting positions.

In another alternative embodiment, players are provided with a remote controlled betting console, or remote system access terminal, which allows the players to place bets on the betting table without having direct access to the table itself.

The casino operating system is an open architecture system designed to accommodate the differing needs of each casino. For example, one casino may be interested in a system to run only its blackjack tables, while another casino may be interested in a system to run all of the games, from slot machines to table games such as roulette, blackjack, craps, poker, big wheel, baccarat, and other types of games. Moreover, a system according to the present invention may grow if the casino operator wishes to expand casino operations.

The casino operating system according to the present invention will now be described with reference to the accompanying drawings.

Figure 1:
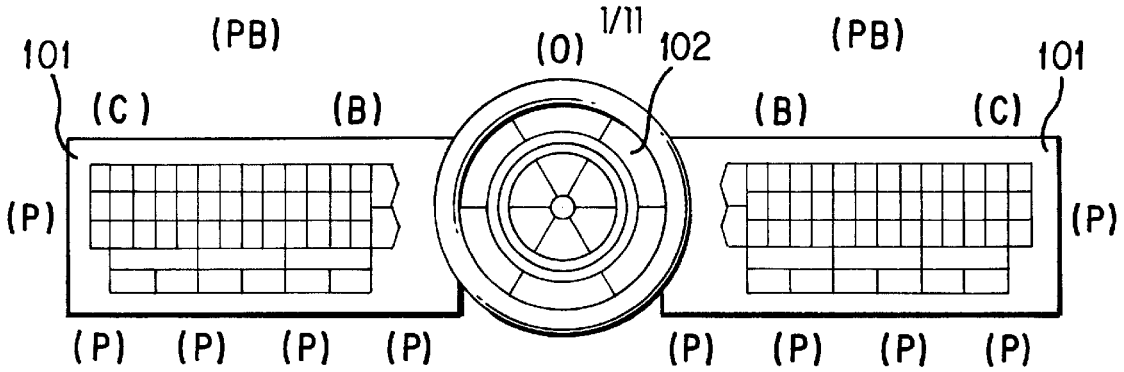
FIG. 1 PRIOR ART
FIG. 1 depicts a prior art configuration for a conventional roulette table set up to accommodate ten players and requiring seven casino employees to run and monitor play.

Note that the first digit or digits of the reference characters in FIGS. 1–18 indicate in which figure the depicted element first appears.

DETAILED DESCRIPTION OF THE PREFERRED EMBODIMENTS

Figure 2:
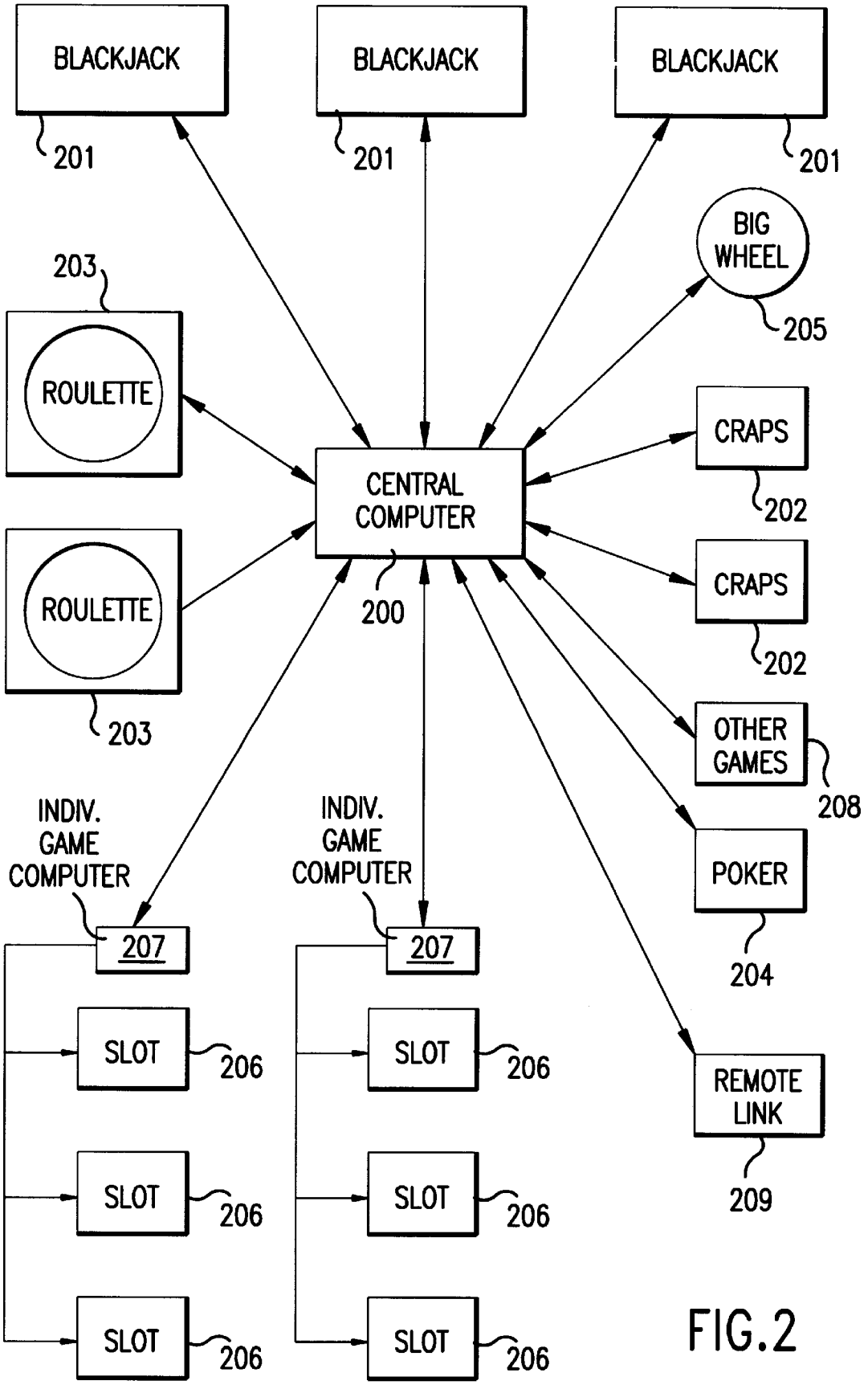
FIG. 2 depicts a block diagram of one exemplary arrangement the elements of the open architecture casino operating system of the present invention.

As shown in FIG. 2, the open architecture casino operating system of the present invention comprises a central computer 200 including at least a central processing unit, a memory, and input and output means (not shown) and connected to a number of individual game computers located within the various gaming tables as shown in FIG.

2. The central computer 200 most conveniently comprises a personal computer having a keyboard, mouse, monitor, and sufficient memory to maintain a stored program and accept and process data as it monitors the operation of the open architecture casino operating system of the present invention. The individual game computers distributed among the individual games, for example, individual game computer 207 for row (or bank) of slot machines 206, also contain at least a central processing unit, a memory, and input and output means, and are adapted to be interconnected with the central computer 200. The individual game computers are also attached to consoles for each individual player and for the dealer. Each individual game computer is set up to monitor one game. For example, each blackjack table 201 has its own individual game computer to monitor the play and betting at that table. This configuration is also used for crap tables 202, roulette tables 203, poker tables 204, big wheel 205, baccarat, and other games 208. Also, each row (or bank) of slot machines 206 has its own individual game computer 207 which collects information from each machine in the row and transmits the collected information to the central computer 200. This configuration allows rows of slot machines 206 to be moved to different locations within the casino.

FIG. 2 shows one exemplary arrangement of the elements of an open architecture casino operating system of the present invention. While three blackjack tables 201, two roulette wheels 203, one big wheel 205, two craps tables 202, one poker table 204, and two rows of slot machines 206 are shown, the system is open architecture in that any number of each and every imaginable gambling game can be accommodated. Moreover, the system may accommodate remote games, as will be further described herein, such as horse races or jailai, through a remote link 209 such as one or more modems coupled to central computer 200. Further, the open architecture casino operating system of the present invention may be constructed such that the central computer directly monitors the individual games, thereby eliminating the individual game computers.

The individual game computers monitor the winnings and losses resulting from each gambling game. These individual game computers are also adapted to monitor play at the gaming tables. The configuration of the individual game computer is different for each type of gambling game and is determined by the operations that need to be monitored in each game to accurately determine winnings and losses for each player and for the house. The configurations for each type of gambling game will be further described below in detail.

Figure 3:
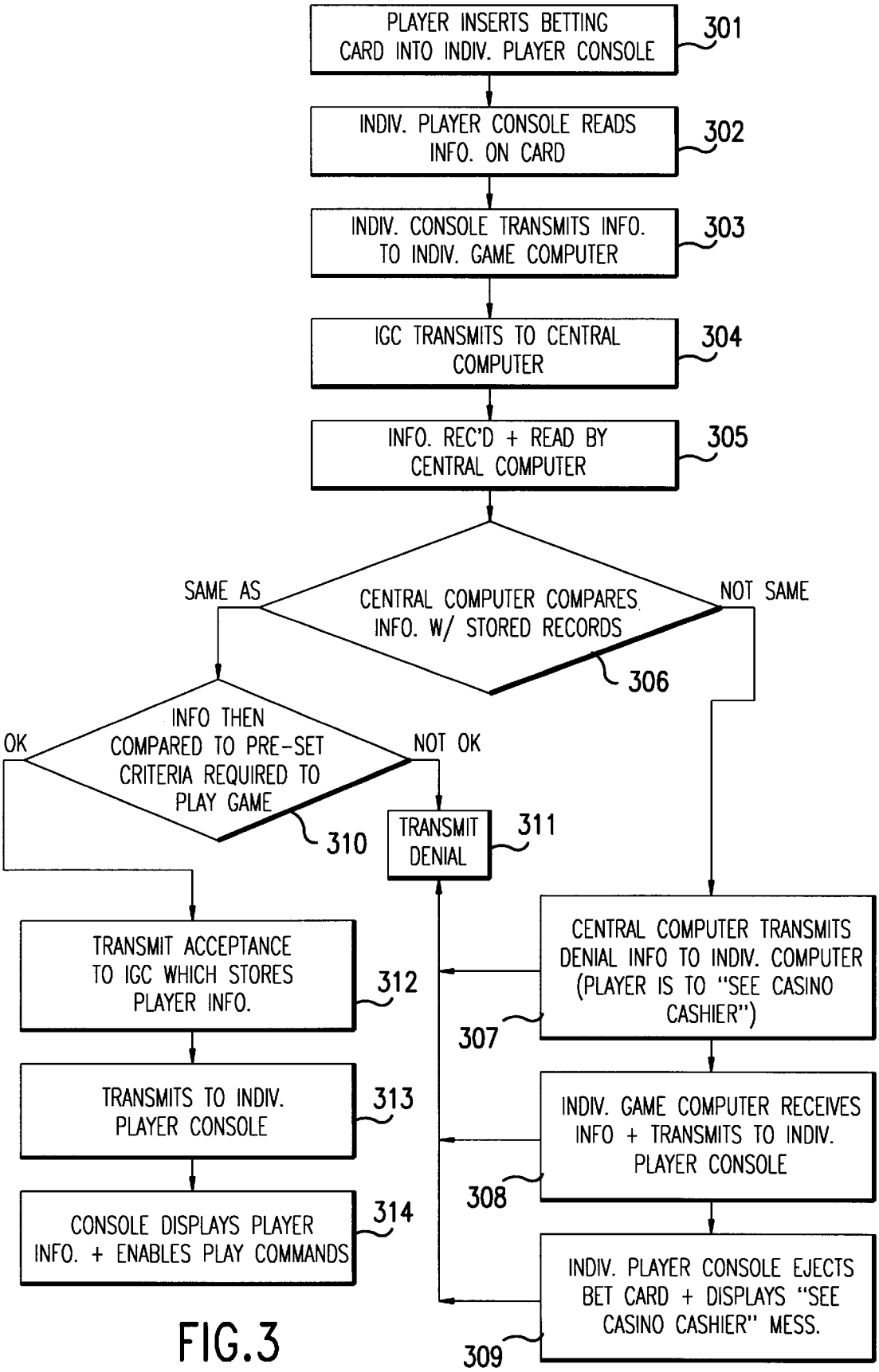
FIG. 3 depicts a flow chart illustrating the player verification process to insure that a player has sufficient credit to play a gambling game in the casino operating system of the present invention.

Communication between the individual game computers and the central computer 200 serves two functions. First, at the outset of the game, the individual game computer sends player information including the player identification and the player's balance to the central computer 200 for verification. In this way, the individual game computer verifies that the player has a sufficient credit balance to play the game. In an alternative embodiment, the individual game computer sends the player identification and the amount bet to the central computer 200 which checks its records and sends a verification signal or a denial signal to the individual game computer. If a verification signal is received, the player is allowed to continue play. If a denial signal is received, the player is not allowed to continue play. The steps of the verification process as illustrated in FIG. 3 include:

301-Player inserts betting card into individual player console.

302-Individual player console reads information on betting card.

303-Individual player console transmits the information to the individual game computer.

304-Individual game computer transmits the information to the central computer.

305-The information is received and read by the central computer.

306-The central computer compares the information with information stored in the central computer.

307-If the information is not the same, the central computer transmits denial information to the individual computer.

308-The individual game computer receives the denial information and transmits it to the individual player console.

309-The individual player console ejects the betting card and displays a "See Cashier" message.

310-If the information stored in the central computer is the same as that from the betting card, the betting card information is then compared to the criteria required to play the game.

311-If the criteria are not satisfied, a denial signal is transmitted as described in boxes 307, 308, and 309.

312-If the information satisfies the criteria, the central computer transmits acceptance to the individual game computer.

313-The individual game computer transmits acceptance to the individual player console.

314-The individual player console displays player information and enables play.

The second function of communication between the central computer 200 and an individual game computer takes place after play is complete. The winnings and losses of each individual player are debited from the player's account by the individual game computer and then sent to the central computer 200. The central computer 200 keeps a running total of the credit available to each player.

During the actual play of the games, the individual game computers do not communicate with the central computer 200. Thus, once a player's credit balance has been verified, or once all bets have been placed, the communication link between the central computer and the individual game computer is temporarily severed. This prevents people with access to the central computer 200, primarily casino employees and remote computer "hackers," from influencing the play and the outcome of the game in progress. It is also possible to scramble the play data generated during play by the individual gaming computer to prevent others from tapping into the gaming computer during play. This may be accomplished by any number of scrambling algorithms known in the art and may preferably include a system of encryption keys changed periodically to secure the data in a well-known manner.

According to an alternative embodiment, the individual game computer is connected to a network which provides the players and the dealer with information generated remotely, such as keno or lottery information, or information about other games being played in the casino. In this instance, the individual game computer continues to receive information from the network and provide it to the players. The link between the central computer and the individual game computer remains intact, but crucial information indicating the outcome of the game, for example, in blackjack, the value of the dealer's face-down card, is not accessible through the central computer.

Figure 4:
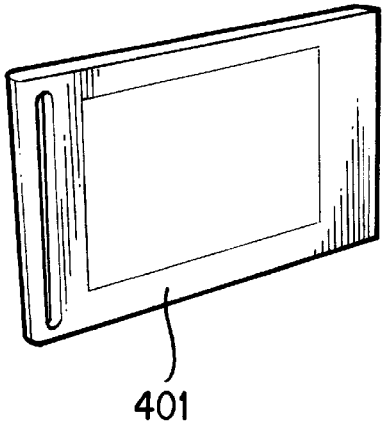
FIG. 4 depicts a player betting card for use in the casino operating system of the present invention.

In order to play the gambling games, players in the casino are provided with betting cards 401 as shown in FIG. 4. The betting cards may be credit cards, bank cards, smart cards or other standard debit cards which at least comprise a variable secure memory and, more appropriately, comprise both a secure microprocessor and memory. They may also be betting cards issued by the casino itself. For example, a player pays money to the cashier at a casino bank to set up a registered account. In return, the player receives a personal betting card 401 for use in all gambling games offered in the casino. The betting card 401 includes at least balance information and data identifying the player. For example, player identification data can identify the player by name, social security number, a random number, or other appropriate information. Anonymous accounts may also be setup in which the player's identification is not revealed by the betting card 401. Instead, the betting card 401 is assigned a number which corresponds to the account number.

In the casino operating system of the present invention, a number of individual game computers are networked to central computer 200 via appropriate communication links such as electrical wire, coaxial cable, fiber optic cable, or radio frequency. The individual game computers are located either within a gaming apparatus or networked to a gaming apparatus from a remote location. The individual game computers, such as individual game computer 207, receive inputs from the central computer, the player consoles, the dealer consoles, and the sensory devices located within the gaming apparatus that monitor activity during play of a gambling game. Using these inputs, the individual game computer generates display signals enabling the player consoles and the dealer consoles to display appropriate options and information to the players and dealer respectively. Once play is concluded, the individual game computer utilizes all of the above described inputs to determine the outcome of the game, i.e., who wins and loses, and the amount of winnings and losses for each player. This information is then transmitted by the individual game computer to the player consoles which will further be described herein, for example, in connection with the discussion of FIGS. 5, 6, 8, and 13, and also to the central computer in order to update the credit information stored on each player's betting card. The central computer 200 updates its stored credit records based on the information generated and transmitted by the individual game computer, for example, individual game computer 207. Further, the player consoles update the information stored on the player's betting card through a card reader\writer (for example, 501 in FIG. 5) attached to the player console.

The following paragraphs will discuss the structure of the gaming machines or tables for each type of gambling station. As each game has different rules and operations, the individual game computers must be modified to monitor each type of gambling game. Further modifications of the individual computers are possible to accommodate new types of games.

SLOT MACHINES

Figure 5:
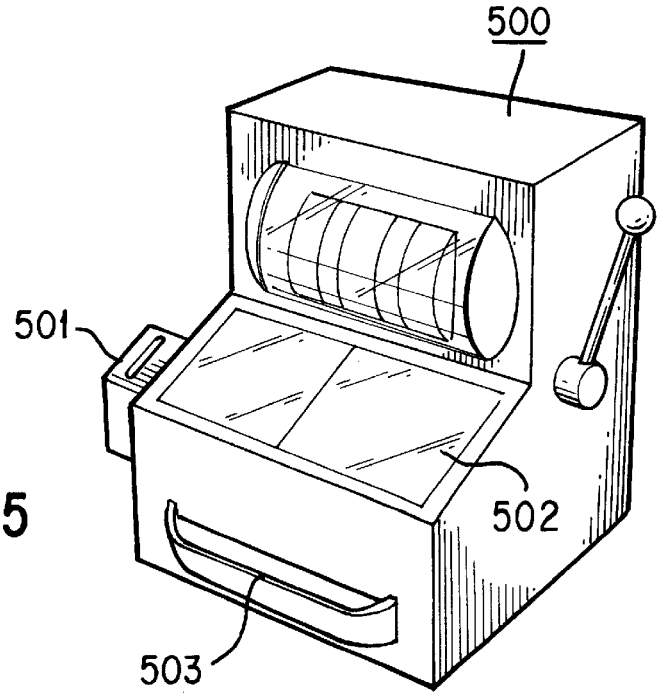
FIG. 5 depicts an automated slot machine for use in the casino operating system of the present invention including a betting card reader and an automated player console.

Slot machines for use in the casino operating system of the present invention include the following features. As shown in FIG. 5, each slot machine 500 is provided with a card reader\writer 501, such as a magnetic, fiber-optic, or bar-code reader, or any card reader/writer device. The card reader 501 is capable of reading betting cards issued by the casino, credit cards, bank cards, smart cards, and other types of cards capable of indicating a credit balance. The card reader 501 includes a delay circuit such that when the player presses the release button to release the card from the card reader 501, the release of the card will be delayed. This is to prevent someone from taking a player's card while the player is turned facing another direction.

Figure 6:
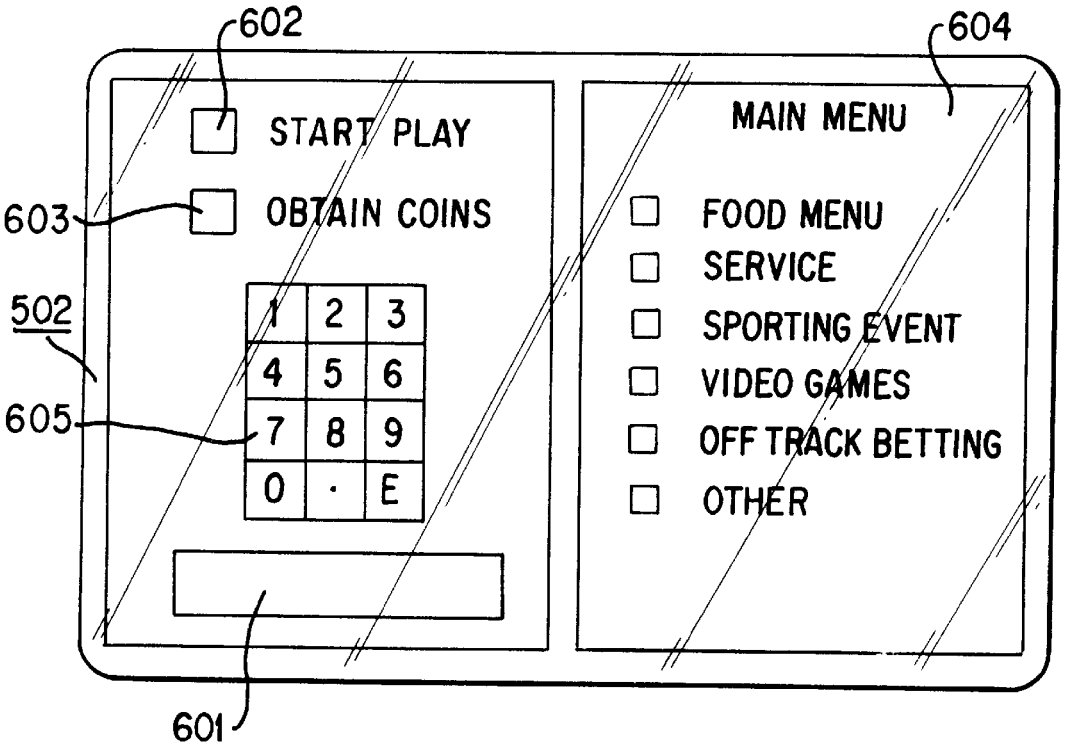
FIG. 6 depicts a player console included on the slot machine shown in FIG. 5, including a touch screen displaying options for playing the slot machine and accessing and selecting other games and services through a main menu.

As illustrated in FIGS. 5 and 6, the slot machine also incorporates a player console having a control panel 502, for example, similar to an ATM type machine. The control panel 502 may also be positioned above the betting wheels (tumblers) on the slot machine 500. The control panel 502 displays the balance on the player's card, for example, on text screen 601, and also has different buttons such as 602 and 603 to allow the player to start play without coins from the card balance or obtain additional coins off of the card balance. Control panel 502 also includes a numeric keypad 605 enabling the player to enter betting amounts and other commands. In an alternative embodiment, text screen 601 and buttons 602 and 603 may be conveniently replaced by a touch screen. Such a touch screen embodiment is driven by a video or graphic display generator, and the touch screen reports the location of the player's touch to the individual game computer for processing the selected data entry. Optional features that may be provided on the player console include:

- an indication signal located on the control panel to indicate that the player has won a random door price offered by the casino as a perk to frequent gamblers.
- electronic menus from the casino listing food and beverages available to the player, and buttons for placing an order with the casino kitchen.
- call buttons for waitress service or for a telephone, for example.
- a display screen providing information on sporting events and betting options for placing bets on the sporting events.
- a display screen providing video gambling games such that the player can play a video game while also playing the slot machine.
- a display screen and command buttons allowing the player to bet on a network lottery, bingo, keno, or any system game run casino-wide or even worldwide while playing the slot machine.
- a display screen and command buttons allowing the player to view information on horse races and place off-track bets.
- a display screen and command button permitting the player to view and place bets on other games being played elsewhere in the casino.

Several of these features are displayed as choices on main menu 604.

A number of the optional features described above enable the player to play a number of gambling games simultaneously, including that game at which the player is sitting and video games or network games. These options will further increase profitability of a casino because people will be able to play multiple games simultaneously, and thus more betting will occur in a given period of time.

In order to provide network access to the individual player consoles in the casino, the central computer 200 will receive network communications from a remote location via remote link 209, for example, one or more modems coupled to central computer 200. When a player selects a network activity on the player's console, the player console will send an access request to the central computer 200 via the individual game computer over a communications link. The central computer then transmits the network communications to the player console via the individual game computer, for example, individual game computer 207. Prior to transmitting network communications, the central computer 200 may also be programmed to check the player's current betting card balance to insure that the player has sufficient credit to participate in network games or activities. Further, in systems in which no centralized computer is utilized, the individual game computer may receive network communications directly, for example via a modem.

Where the player consoles include a reprogrammable display controller, the individual player consoles also allow the player to choose the language in which information is to be displayed on the screen, thereby allowing people to gain access to the games and other information in their native language.

In all embodiments, the individual player consoles are designed to be user friendly with colorful displays and easy-to-read features. For example, a player's winnings can be displayed as stacks of chips even where no chips are actually used in the game.

According to the present invention, two options are available to the player. The player can play solely from the credit balance on the card such that no coins are involved, or the player can have the machine issue coins from the balance on the card into coin tray 503 and then play the slot machine with these coins.

The player's card remains inserted in the card reader 501 during play until the game play is over. The individual game computer, for example, individual game computer 207, then debits the card or credits the card depending on winnings.

The individual game computer will also include a mechanism to count the number of coins dispensed by each slot machine 500. The counting mechanism can be any used in conventional slot machines, but the output of the counter is provided to the individual game computer in addition to the slot machine 500.

Coin counting serves several functions. Counting will ensure an adequate supply of coins in each machine. Counting will also ensure that the number of coins won equals the number of coins actually paid out to the player. If the number of coins suppose to be dispensed does not equal the number of coins actually dispensed, a silent or audible alarm signal is sounded. In an alternative embodiment, in addition to sounding an alarm, a message is displayed to the player to await the arrival of security personnel. Thus, coin counting protects the casinos from theft due to slot machine tampering.

According to the casino operating system of the present invention, a conventional slot machine may be provided with a standard magnetic card reader. However, bar code scanners, smart card readers, or laser scanners may also be used.

Any number of variations of the arrangement of features of the embodiment described above are possible depending upon the needs of the casino, limited only by the required functions of the individual player consoles 502, the individual game computer 207, and the gaming apparatus 500. The position and arrangement of each of the components can vary according to the requirements and designs of the casino.

Each row of slot machines 206 is interconnected with one individual game computer 207 via a cable as shown in FIG. 2. The cable transmits the information read by the card readers, be they magnetic, fiber-optic, bar code, or any other suitable equivalent, to the individual game computer 207 which is then connected to the central computer 200. The central computer 200 monitors winnings and losses of the individual players at the slot machines 206. The central computer 200 may also be programmed to report the winner's amounts by social security number, for example, for purposes of accounting to the Internal Revenue Service, via remote link 209.

BLACKJACK

Figure 7:
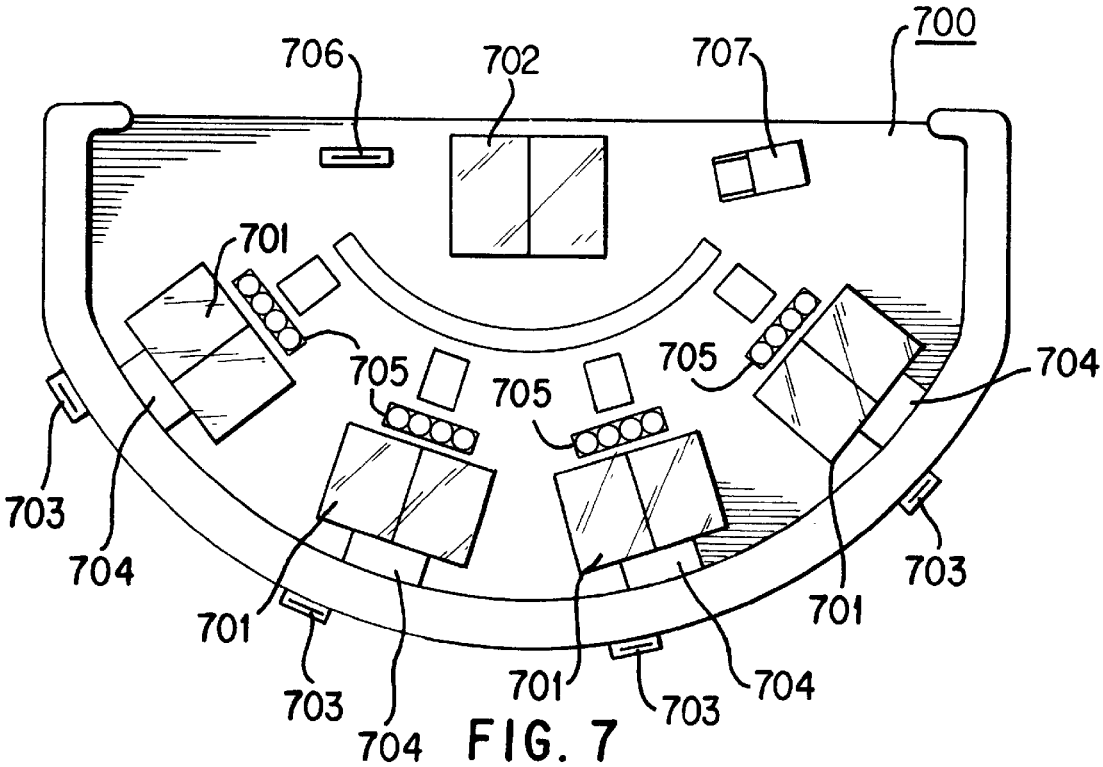
FIG. 7 depicts an automated blackjack table for use in the casino operating system of the present invention including player consoles, betting card readers, chip trays, a dealer console, a card shoe, and a cash slot.
Figure 8:
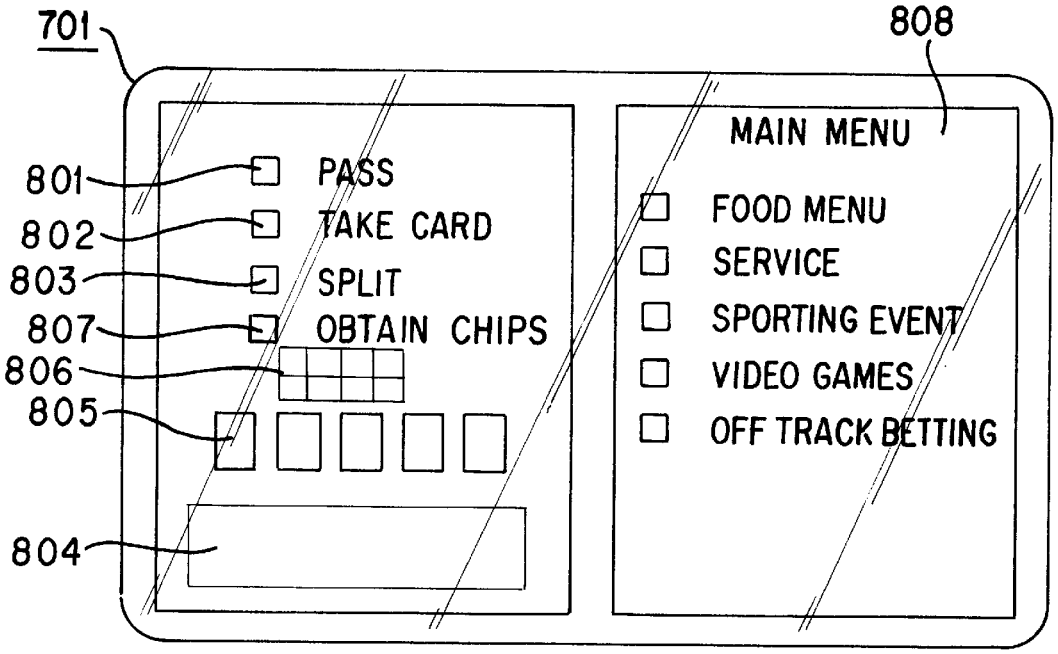
FIG. 8 depicts a player console included on the blackjack table shown in FIG. 7, including options for playing the game and accessing other games and services through a main menu.

A blackjack table for use in the casino operating system of the present invention includes the following features. As illustrated in FIG. 7, on a blackjack table 700, an individual console panel 701 is provided for each player, of which four are shown. The blackjack table 700 may include more or fewer player positions as are appropriate. A similar console panel 702 is provided for the dealer. These consoles 701 and 702 can be similar to an ATM machine with a keyboard, or touch sensitive (re-programmable) screen, or have any other known display configuration which operates to display the necessary information to the player and accept player commands. Returning to FIG. 7, the size of the player console 701 allows the player to see the cards dealt to him as well as the amount bet and the outcome of the game. As shown in FIG. 8, the player is provided with a means such as 801, 802 and 803 to indicate whether the player wishes to pass or take a card in the game as well as a button or other means for entering a split option or any other options allowed in the game. House rules determine the number of splits and other possible options allowed in the game. Additional options available on the console are information about the last sequence of the player's games, the average wins and losses, and other information displayed on text screen 804, or access to services and amenities such as those shown on main menu 808 and those described relating to the slot machine player console, and insurance options depending on house rules. All options listed above with respect to the slot machine consoles are also available for blackjack consoles. Furthermore, the individual game computer can be programmed to accommodate any house rules or options.

The player console 701 also includes a card reader 703 such as a magnetic card reader, a bar code reader, a smart card reader, or an optical scan reader. The card readers 703 read the credit limit from the player's betting card, credit card, bank card, or other credit-bearing card. The card readers 703 are programmed with a delay function to prevent immediate release of the card out of the card reader. For this embodiment, the card may not be accepted until the personal data entered by the player matches the data stored in the card.

Figure 9:
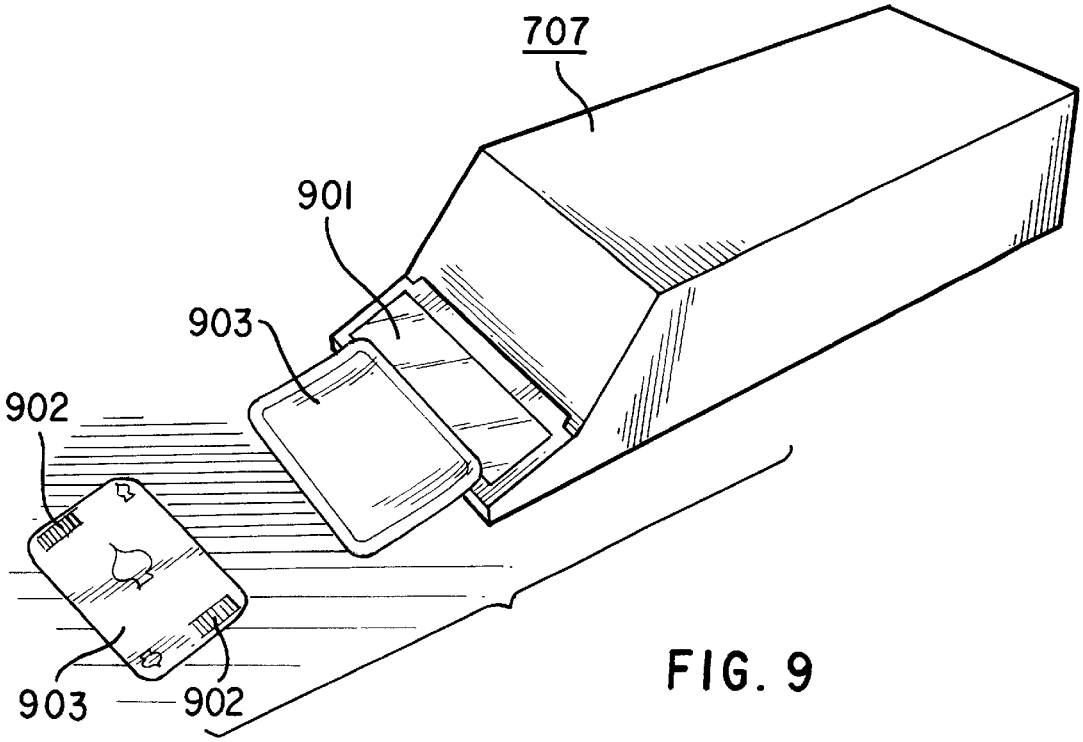
FIG. 9 depicts a card shoe included on the blackjack table shown in FIG. 7, including scanning means for scanning codes provided on playing cards dealt in the blackjack game.

Referring to FIG. 9, monitoring of the cards dealt during play is accomplished, for example, using one or more laser scanners within a scanner window 901 that are positioned to read optical codes 902 such as bar codes off of the cards 903 dealt from the card shoe 707 held by the dealer. Other known types of codes and scanning means may also be used, for example, infrared or magnetic codes and scanners. As shown in FIG. 9, an indicator, such as a red and a green light or a light emitting diode (not shown), is provided on the card shoe, within the scanner window 901, or on the table to indicate when the cards 903 have been properly scanned. Play is stopped until proper scanning occurs. The cards 903 may have a one or more codes 902, for example two identical codes in different positions, on the face of each card. The individual gaming computer for the blackjack table 700 will be programmed to assign the cards dealt in a certain order to each player. As a result, the cards of each player will be displayed on their individual player console 701. The console display screen for displaying cards can be as simple as a number or letter plus one of the four symbols (hearts, clubs, spades and diamonds) or more elaborate and user-friendly, for example, displaying images of the cards dealt 805 as shown in FIG. 8. In this way, the individual game computer (not shown) for the table knows which cards are dealt to each player as well as the dealer and is able to calculate the outcome of the game. Winnings and losses information is calculated for each player by the individual game computer and sent to the individual player consoles 701 for crediting or debiting the individual player card. The winnings and losses information is also sent to the central computer for accounting purposes to maintain an accurate record of the player's credit balance on the betting card 401.

Blackjack tables set up in this manner can be operated in two different ways. One way is to use betting cards exclusively such that there are no actual betting chips used in the game. However, as betting chips are often preferred by players, this system can be modified to use both cards and chips in play.

If betting chips are used, the player inserts a betting card into the console card reader 703 and enters a command, for example, using numeric keypad 806 and button 807, for the individual game computer to issue a certain value of chips to the player. The value of the chips is subtracted from the player's betting card, and the chips are distributed to the player from inside the table into a recessed tray 704 in the table, for example, positioned in front of the player, similar to a slot machine tray. As shown in FIG. 7, in the preferred embodiment, the recessed tray 704 is positioned within the surface of the blackjack table 700 such that the players' hands remain above the table at all times during play of the game.

Further, a chip receiving structure 705 is provided such that the chips bet by each individual player are placed into the chip receiving structure 705 and dropped into a central location once betting has been closed. When the chips are dropped down into the table, they are scanned to determine their value. Alternative means, such as a slanting rack structure, may also be used to hold the chips in a betting position such that the amount of the bet may be automatically determined. As shown in FIG. 7, in the preferred embodiment, the chip receiving structure 705 is positioned in front of the player console to enable the dealer to more easily monitor player betting activity.

When a player has finished playing at a particular table, the player may cash out by selecting this option on the player console and inserting all of the player's chips into the chip receiving structure 705. The sensed value of the chips will be credited to the player's betting card 401.

Figure 18:
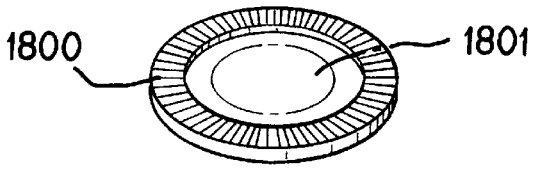
FIG. 18 depicts a smart betting chip including an integrated circuit (IC) chip which transmits the identification information to remote sensors allowing the sensors to detect the value of the chip from the transmitted identification information.

There are a number of possible ways of scanning these chips according to the present invention. With reference to FIG. 18, one possibility is to provide a computer chip or other memory device 1801 inside each betting chip indicating the value of the gaming chip to create a smart betting chip 1800, or smart currency. In the preferred embodiment, the internal computer chip 1801 transmits identification information, for example, as radio frequency data, which indicates the identification and value of the smart betting chip 1800. In this way, a remote reader (not shown) within the blackjack table 700 can read the value of the smart betting chip as the it falls past the reader by receiving and processing the identification information transmitted by the chip 1801 within the smart betting chip 1800. If an internal computer chip is used in each smart betting chip, the internal computer chip can be programmed to have a day and month code as well as a casino identification code to indicate which casino issued the smart betting chip and for what period of time the smart betting chip is valid. This type of identification will prevent counterfeiting of the chips. The smart currency may also be reprogrammed on a daily or monthly basis.

In an alternative embodiment, sensors may also be provided to detect, for example, the color, size or weight of the chip if chips of different values have different colors, weights and sizes. Once the individual gaming table has calculated the winnings and losses of each individual player based on the cards dealt, the players who have won will be paid out through the recessed tray 704 in the table. As in a slot machine, the number of chips or the amount of chips will be counted as the chips are distributed to the individual players in the recessed trays 704.

Figure 10:
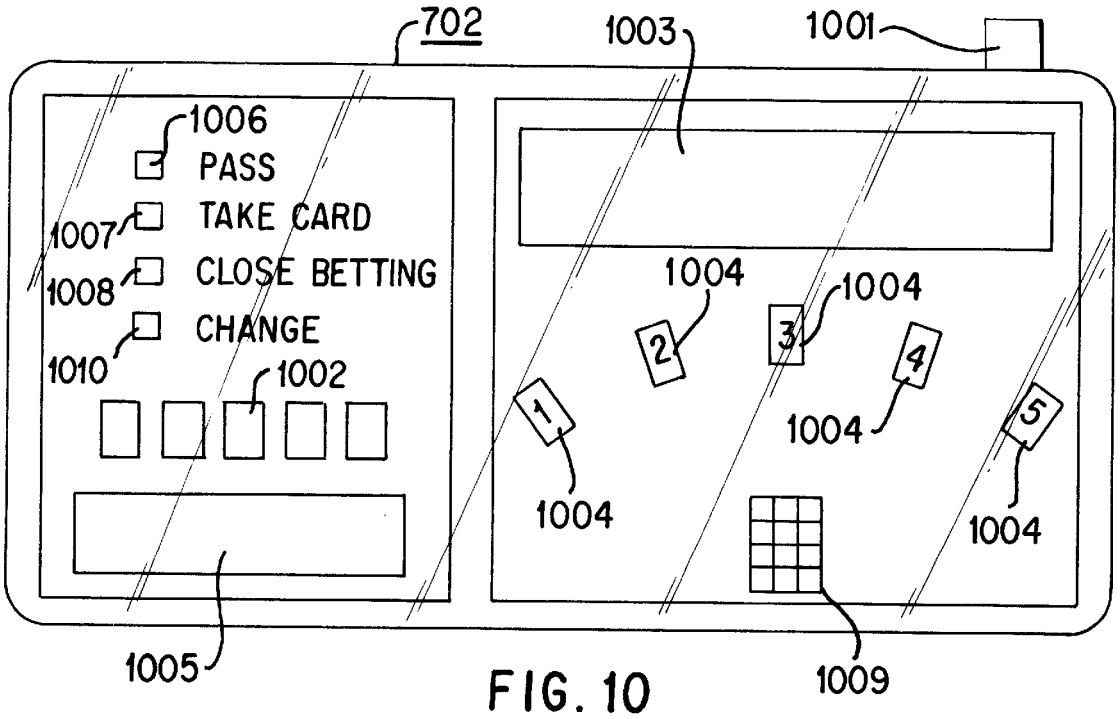
FIG. 10 depicts a dealer console included on the blackjack table shown in FIG. 7, including options for playing the game and indicators indicating play options of the players.

As illustrated in FIG. 10, the console panel 702 provided for the dealer includes the following features. Buttons such as 1006, 1007, and 1008 are provided to enable the dealer to play the gambling game. Game information is displayed on text screen 1005. An indication is provided that is visible to the players indicating that no more bets are allowed for the current game, for example, indicator light 1001. An indicator may also be provided on the individual player consoles 701. If chips are used, when this light or indicator goes on, the chips stacked in the trays are released into the table for counting. If only betting cards are used, the player console 701 indicates to the player that betting is closed. The dealer panel 702 also displays the dealer's hand, for example, in display windows 1002, and the winnings or losses of the individual players, for example, in display windows 1004 or text window 1003. The winnings are distributed to the appropriate players by the individual game computer (not shown) located within the table either in chips or as a credit to the player's betting card balance.

An additional function of the dealer is to provide chips or credit in exchange for cash at the table, for example, using a numeric keypad 1009 and change button 1010. This may be accomplished by having the dealer deposit money into a drop box or slot 706 which is kept locked and which is picked up by a pit boss periodically. The money in the box is then taken to a cashier for counting to ensure the amount stated to be in the box is in fact in the box. According to another embodiment of the present invention, money is sent via a pneumatic tube system (not shown), such as banks use for collecting and distributing to remote drivers from teller windows, to a cashier for counting immediately. The capsule used in the pneumatic tube containing the money preferably will also be encoded with the identity of the reporting table. Collection will be done per hour or as frequently as every ten minutes. In exchange for money, the dealer provides chips or betting card credit to the players by entering the appropriate commands into the dealer console 702.

Any number of variations of the arrangement of features of the embodiments described above are possible depending upon the needs of the casino, limited only by the required functions of the individual player consoles 701, the dealer console 702, the individual game computer (not shown) within the gaming apparatus, and the gaming apparatus 700. The position and arrangement of each of the components can vary according to the requirements and designs of the casino.

POKER

Figure 11:
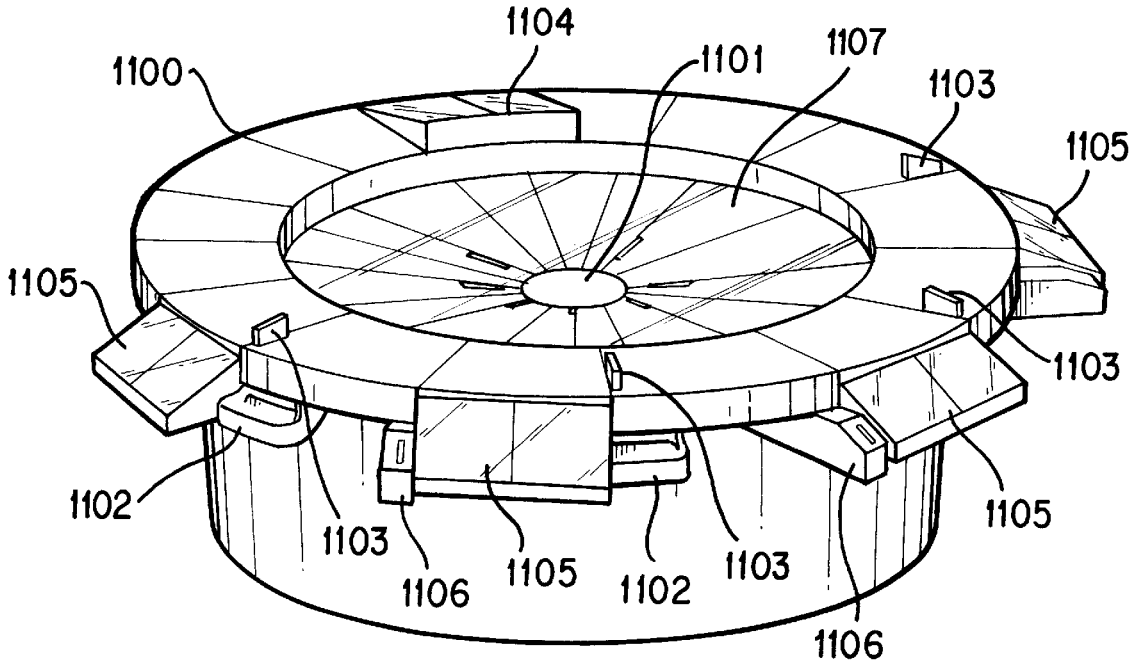
FIG. 11 depicts an automated poker table for use in the casino operating system of the present invention including player consoles, betting card readers, betting chip slots, a recessed central area for collecting betting chips, and a dealer console.

Referring to FIG. 11, in the game of poker, an important issue is the accurate monitoring of the amount of money in the center pile (the pot) which has been bet by all of the players. Two possible ways of accomplishing this are: (1) to count the center pile as it is distributed to the winning player, or (2) to maintain a cumulative count of the center pile as each individual player adds money to the pile. Therefore, a poker table for use in the casino operating system of the present invention has a number of features as shown in FIG. 11, including a recess 1101 in the center of the poker table 1100 into which the betting chips are fed and a flat transparent table top 1107 onto which cards can be dealt. The poker table 1100 may also have an oval shape to facilitate dealing of the cards.

To count the betting chips after the pile has been won, a chute is provided to each individual player with a sensor for reading the value of the chips passing through the chute to the individual player's recessed tray 1102. Smart betting chips 1800 are used in the preferred embodiment, wherein the IC chip 1801 within the smart betting chips 1800 transmits identity and value information to the sensor as the smart betting chips 1800 slide past the scanner in the chute. Thus, when a player wins the pot, the chips in the pot are distributed to the player through a chute. The chute contains a sensor that counts the value of the chips distributed to the player.

To cumulatively count the tray as individual players place bets, a feature similar to blackjack tables is provided whereby players deposit the smart betting chips 1800 into a chip receiving structure 1103, for example, a slot or recessed tray within the surface of the table with an opening leading into the central recess 1101. The smart betting chips 1800 will then fall through the chip receiving structure 1103 into the center recess 1101 of the table 1100. A sensor within the slot is provided to read the value of the smart betting chips 1800 being fed to the central recess 1101 of the table. The system in which smart betting chips are counted as each player bets is preferable because this allows the individual gaming computer for the table to keep track of the individual winnings and losses of each player. Further, by counting the pile in the middle of the table once betting has been completed, the individual game computer (not shown) located within the poker table 1100 signals the dealer console 1104 and calculates the amount representing the house percentage. In poker, the amount taken by the house is a percentage of the amount in the pile. In the preferred embodiment, smart betting chips 1800 in the amount of the house percentage are subtracted automatically from the smart betting chips 1800 paid out to the winner of the game.

The individual player consoles 1105 for poker players include a betting card reader 1106 to allow players to bet the balance on the card. As in blackjack, players can use chips, such as smart betting chips 1800, or betting cards only. All of the optional features described with respect to slot machine consoles are also possible for the player consoles in poker. Unlike in blackjack, in poker, the console need not display the hands dealt to each player. The crucial information to be displayed and/or maintained in a secure manner in the game is the amount in the pot.

The cash out option described with respect to blackjack is also available at the poker table in the casino operating system of the present invention. Players deposit all of their chips into the chip receiving structure 1103, and their individual player console 1105 credits their betting card with the amount of the deposited chips.

In an alternative embodiment (not shown), the player consoles 1105 are mounted on the top of the poker table. The card readers 1106 are positioned next to the player consoles, and the recessed trays 1102 are also provided in the surface of the table.

Any number of variations of the arrangement of features of the embodiments described above are possible depending upon the needs of the casino, limited only by the required functions of the individual player consoles 1105, the dealer console 1104, the individual game computer (not shown) within the gaming apparatus, and the gaming apparatus 1100. The position and arrangement of each of the components can vary according to the requirements and designs of the casino.

ROULETTE

Figure 12:
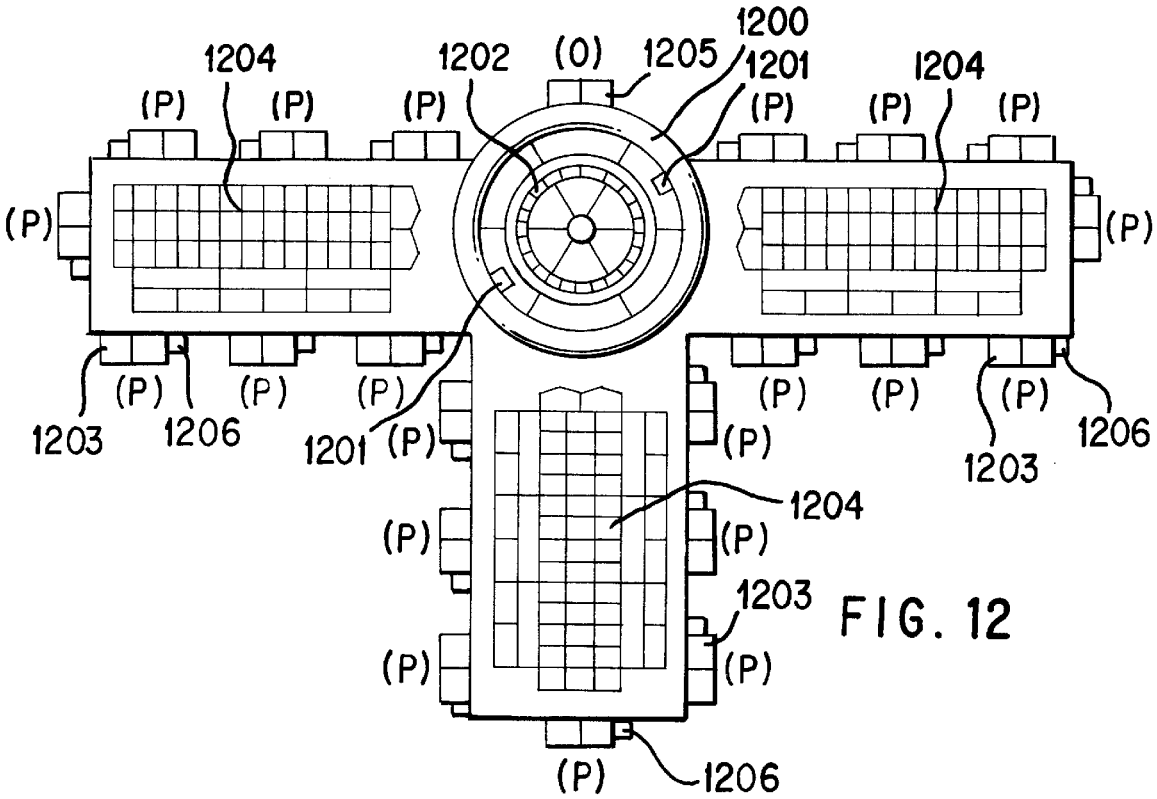
FIG. 12 depicts one embodiment of an automated roulette table for use in the casino operating system of the present invention including individual player consoles, card readers, roulette ball movement sensors, and a dealer console.

Referring to FIG. 12, a roulette table for use in the casino operating system of the present invention includes the following features. The roulette wheel 1200 is provided with a system in which sensors, for example, proximity sensors, are placed in each position 1202 on the roulette wheel 1200 such that when the ball lands in a position 1202, the sensor indicates this position to the individual gaming computer (not shown) for the roulette game located within the structure supporting roulette wheel 1200. In addition, the rotations per minute of the wheel or the speed of travel of the ball can be sensed, for example, by an infrared motion sensor 1201, and reported to the individual game computer to be compared against a predetermined minimum speed. If the speed is less than the predetermined minimum, the computer will indicate on each of the individual player consoles 1203 that betting is no longer possible. An additional option is an indication of the speed of the ball or betting time remaining on each player console 1203 so that the players (P) would know how long they had remaining to place bets in the game.

Figure 13:
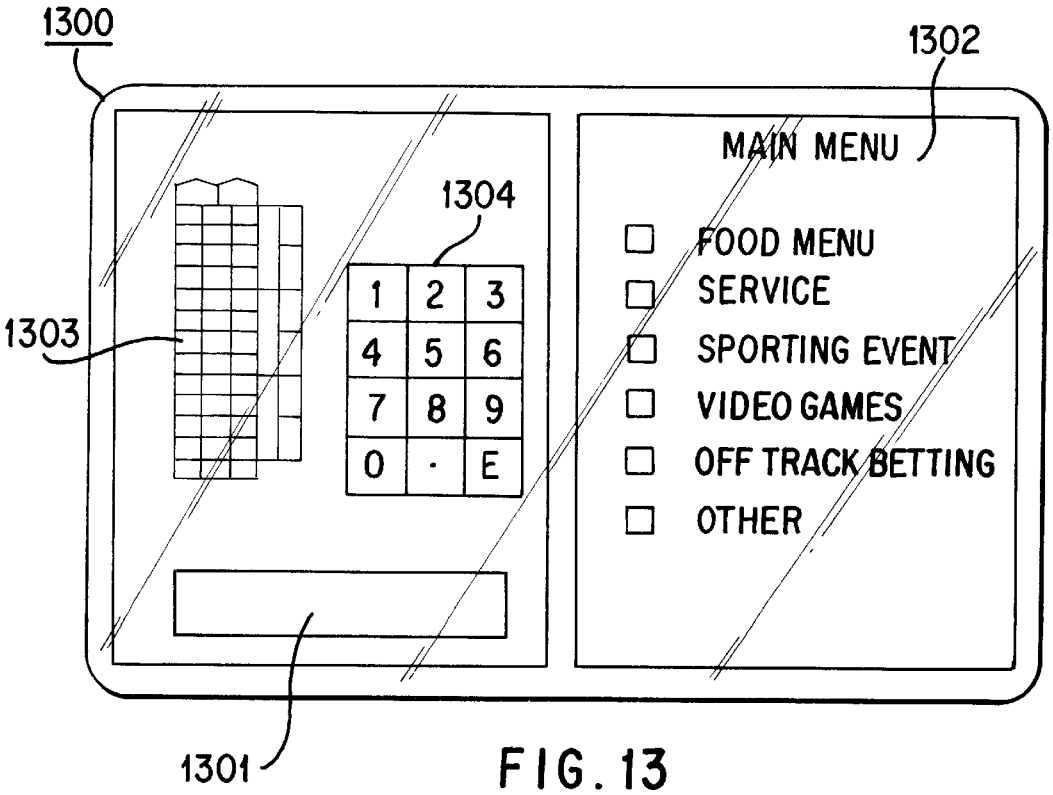
FIG. 13 depicts a player console included on the roulette table shown in FIG. 12, including options for playing the game and accessing other games and services through a main menu.

Each player console 1203 in the game of roulette includes a card reader 1206 such as a magnetic card reader to allow people to bet from the balance on their betting card, a credit card, bank card, smart card, or other credit-bearing card. A delay release feature is also provided for the card readers 1206. As shown in FIG. 13, the player console 1203 is similar to that for blackjack in that it indicates the credited balance of the player, the amount of the bets placed and the winning number in the game, for example, on text screen 1301. It also provides additional features such as those described with respect to slot machine consoles, including the main menu of options 1302.

Several of the possible embodiments of the roulette game according to the open architecture casino operating system of the present invention will now be described with reference to FIGS. 12, 13 and 15.

With reference to FIG. 12, one embodiment of the roulette game includes a betting marker (not shown), for example, a light pen or betting wand, which contains a integrated chip indicating the identity of the player and transmitting signals addressed to its corresponding player console 1203. One betting marker is linked to each individual player console 1203 either by physical means, such as a coaxial or fiber optic cable, or through transmitted communications, such as radio frequency, infrared, or ultrasonic data. Players use the betting markers to read betting positions on the roulette betting table 1204. In this way, players place bets on positions on the table. One possible type of betting marker includes an LED on the end of the wand that signals a sensor in the table the position desired by the player. In this type of apparatus, the betting marker may also indicate to the sensor on the table which player is placing the bet. The betting marker may include an indicator light to indicate to the player that the marker has been correctly sensed by the table sensor or that the marker has correctly sensed the betting position on the table. For this embodiment of the present invention, the individual player consoles 1203 are positioned around the edges of betting tables 1204 as shown in FIG. 12. The betting table 1204 includes table sensors (not shown) positioned within the surface of the betting table 1204 at each possible betting position.

Figure 15:
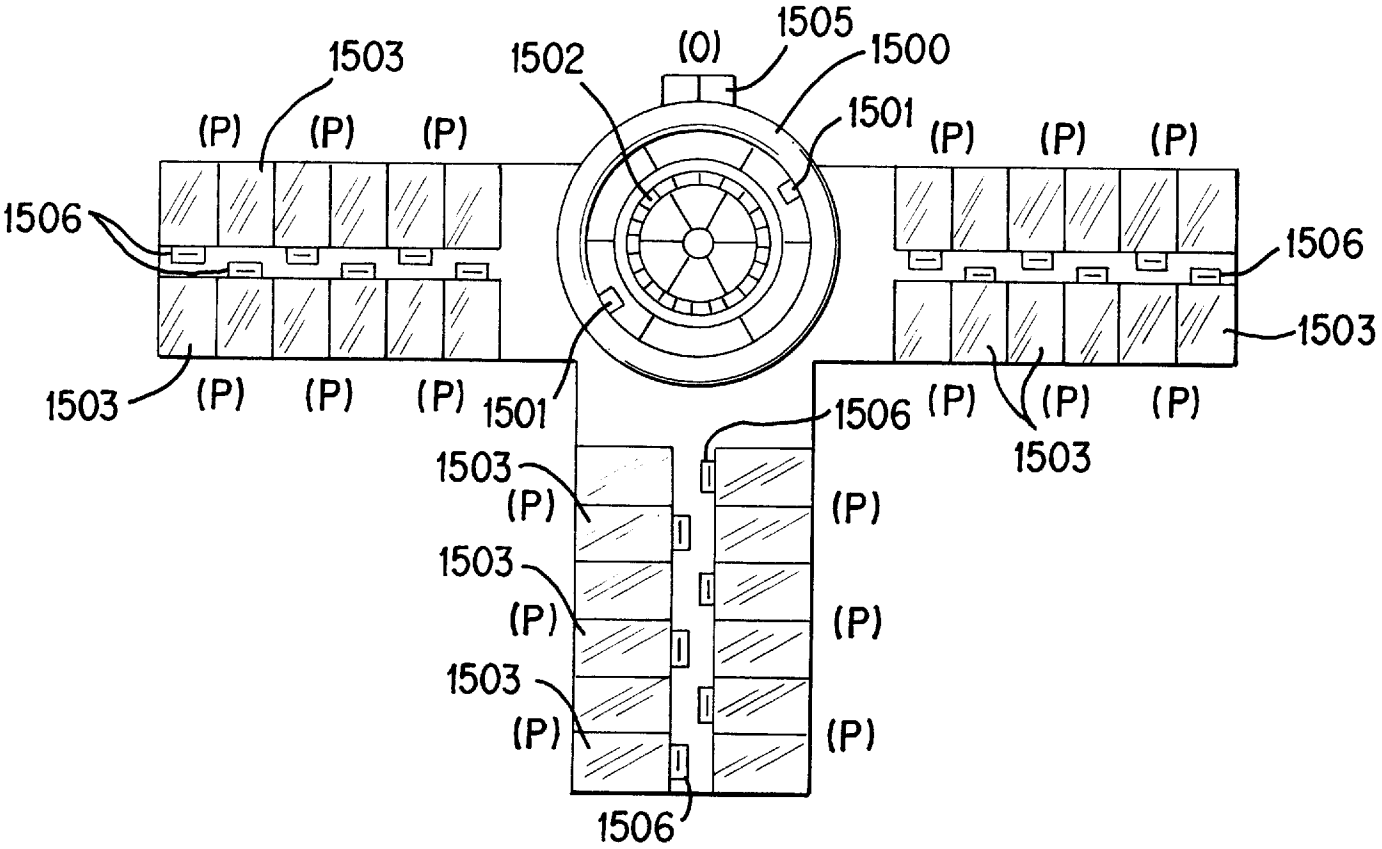
FIG. 15 depicts a second embodiment of an automated roulette table for use in the casino operating system of the present invention including individual player consoles, card readers, roulette ball movement sensors, and a dealer console.

With reference to FIGS. 13 and 15, an alternative embodiment of the roulette table for use in the open architecture casino operating system of the present invention eliminates the need for betting tables 1204 shown in FIG. 12 such that the individual player consoles 1503 may be positioned directly on the betting tables as shown in FIG. 15. A detailed view of the individual player consoles 1503 used in this embodiment are shown in FIG. 13. These individual player consoles 1300 include a small version of the entire betting table 1303 on the console screen. In this embodiment, players use a touch screen, for example, to indicate the positions on the table where they wish to place bets. Players indicate the amount of each bet and each position by using the touch screen features provided on the console, for example, by using numeric keypad 1304. The individual player console is capable of all functions described above with respect to slot machines and FIG. 6, for example, those listed in Main Menu 1302.

In an alternative embodiment (not shown), instead of a touch screen, a drawing of the betting table is provided on the console with buttons in the different betting positions. In this embodiment, the player places bets by hitting the button marking the chosen position on the betting table.

As in FIG. 12, FIG. 15 also illustrates a roulette wheel 1500, sensors 1501, landing positions 1502 for a roulette ball, card readers 1506, and a dealer console 1505.

Figure 16:
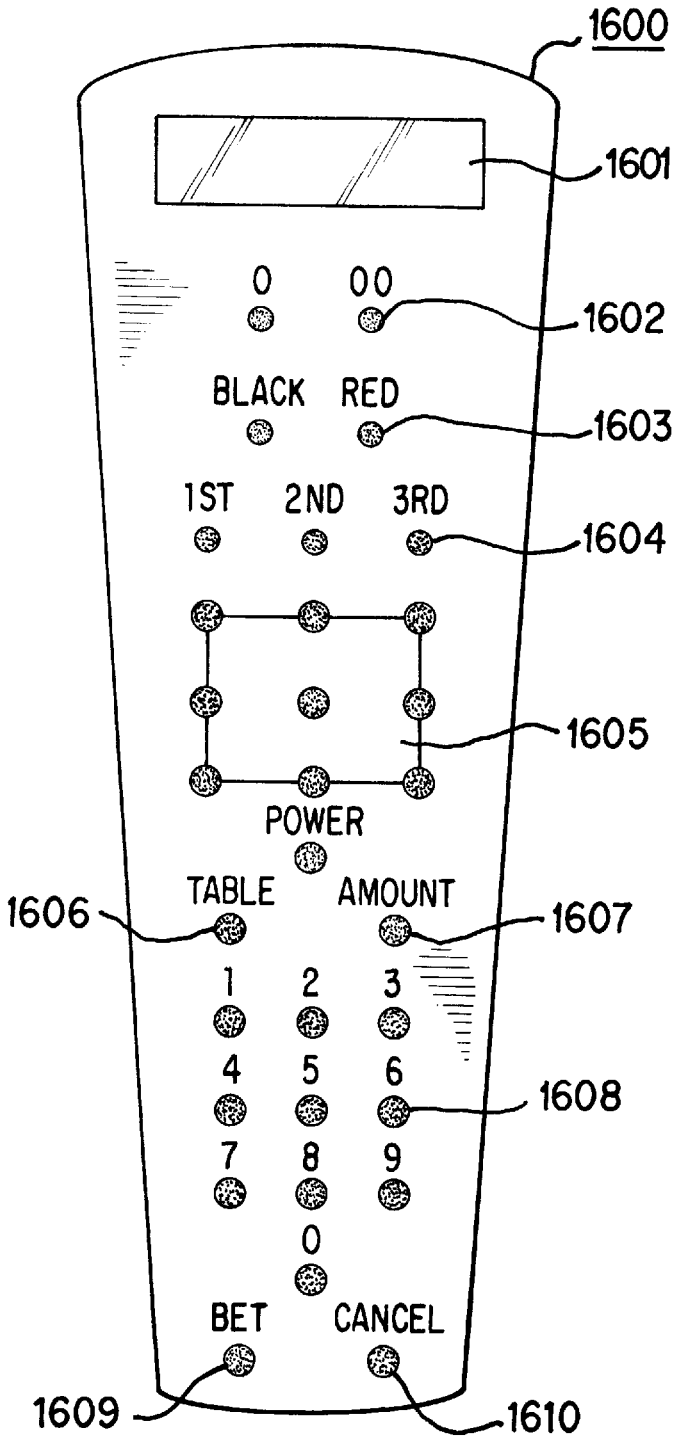
FIG. 16 depicts a remote system access terminal (RSAT) for placing bets at a roulette table at a distance from the table, for example, when all of the player consoles at the table are being used by other players.

With reference to FIGS. 12, 15, and 16, in an alternative embodiment of the roulette game according to the open architecture casino operating system of the present invention, players who want to play at a particular roulette table but are unable to gain access to one of the individual player consoles 1203 or 1503 may obtain a two-way remote system access terminal (RSAT), a remote betting console as shown in FIG. 16.

The RSAT 1600 is a portable two-way controller which transmits information to a selected individual game computer and receives information from the selected individual game computer. The RSAT includes at least a receiving means, for example, a radio frequency receiver; a transmitting means, for example, a radio frequency transmitter; a processor including a central processing unit, a random access memory, and a read only memory; a input means, such as a keyboard, push buttons, or a touch sensitive multi-function user input; and a display means, for example, a liquid crystal display, an LED display, a braille reader, or a CRT device.

With reference to FIG. 16, a player obtains an RSAT 1600 by inserting a betting card 401 into an RSAT holder (not shown) to release the RSAT 1600. When the player inserts a betting card 401 into a RSAT holder, the RSAT 1600 downloads player information including credit balance information from the betting card 401 into the random access memory. Once the RSAT 1600 has downloaded the player information from the betting card 401, the RSAT holder releases the RSAT 1600 which is portable and can be carried around the casino by the player. The player's betting card 401 remains in the RSAT holder until the RSAT 1600 is returned to the holder. Once the player has returned the RSAT 1600 to the RSAT holder, winnings and losses information from the RSAT 1600 generated during the player's use of the RSAT 1600 is downloaded from the RSAT 1600 into the betting card 401. Once downloading is complete, the betting card 401 is released from the RSAT holder.

The RSAT holders may be located at the periphery of the roulette table adjacent to the player consoles 1503, at the casino cashier booth, at the operator's station at the roulette wheel 1500, or in any other convenient location in the casino. The RSATs 1600 are either assigned a table number corresponding to one roulette table in the casino, or the RSATs 1600 are provided with a selection means, such as a selection key or a scanner to read a table number, to ensure that the player using the RSAT is in contact with the individual game computer at the table on which the player wishes to place bets.

The RSATs 1600 communicate with the individual game computer monitoring the game on which the remote player is betting. Each RSAT 1600 transmits player identification information and betting information to the individual game computer (not shown) within the roulette table. Once play of the game is completed, the individual game computer transmits winning and loss information to the RSAT 1600. The individual game computer also transmits the winning and losses information to the central computer 200 along with the player identification information from the RSAT 1600. In this way, the central computer 200 maintains an accurate record of the credit balance of the player. In systems in which only a central computer 200 is used to monitor gaming activities instead of individual game computers, the RSAT communicates with the central computer directly.

As discussed above, when the player returns the RSAT 1600 to the RSAT holder and retrieves the betting card 401, the RSAT updates the betting card credit balance and releases the betting card 401 to the player.

Communications between the RSAT 1600 and the individual game computers can be preferably accomplished using radio frequency transmissions. However, infrared, ultrasonic, and other types of known communication may also be used.

In one embodiment of the RSAT 1600 illustrated in FIG. 16, a player uses numeric keypad 1608, amount button 1607, and a bet button 1609 to send a bet to the individual game computer at a selected table. The player uses the numeric keypad 1608 and the table button 1606 to select the number on the table on which the player wishes to place the bet. The player enters the position of the desired bets using buttons 1602, 1603, 1604, and 1605. A display screen 1601 displays information to the player, and a power button is provided to enable the player to shut off the RSAT 1600, for example, while the player is watching play at a number of tables to determine where to play. A cancel button 1610 is also provided to clear the current bet before it is sent to the table or to cancel a bet placed at a table before the end of play.

In each of the embodiments described above, the roulette wheel operator (O) is also provided with a console 1205 or 1505 for the purpose of providing credit to players in exchange for cash. This could be accomplished as described above with respect to blackjack and poker.

The roulette table for use in the open architecture casino operating system of the present invention may also be configured to accommodate the use of betting chips, such as smart betting chips 1800.

Any number of variations of the arrangement of features of the embodiments described above are possible depending upon the needs of the casino, limited only by the required functions of the individual player consoles 1203 or 1503, the RSAT 1600, the dealer console 1205 or 1505, the individual game computer (not shown) within the gaming apparatus, and the gaming apparatus 1200 or 1500. The position and arrangement of each of the components can vary according to the requirements and designs of the casino.

CRAPS

Figure 14:
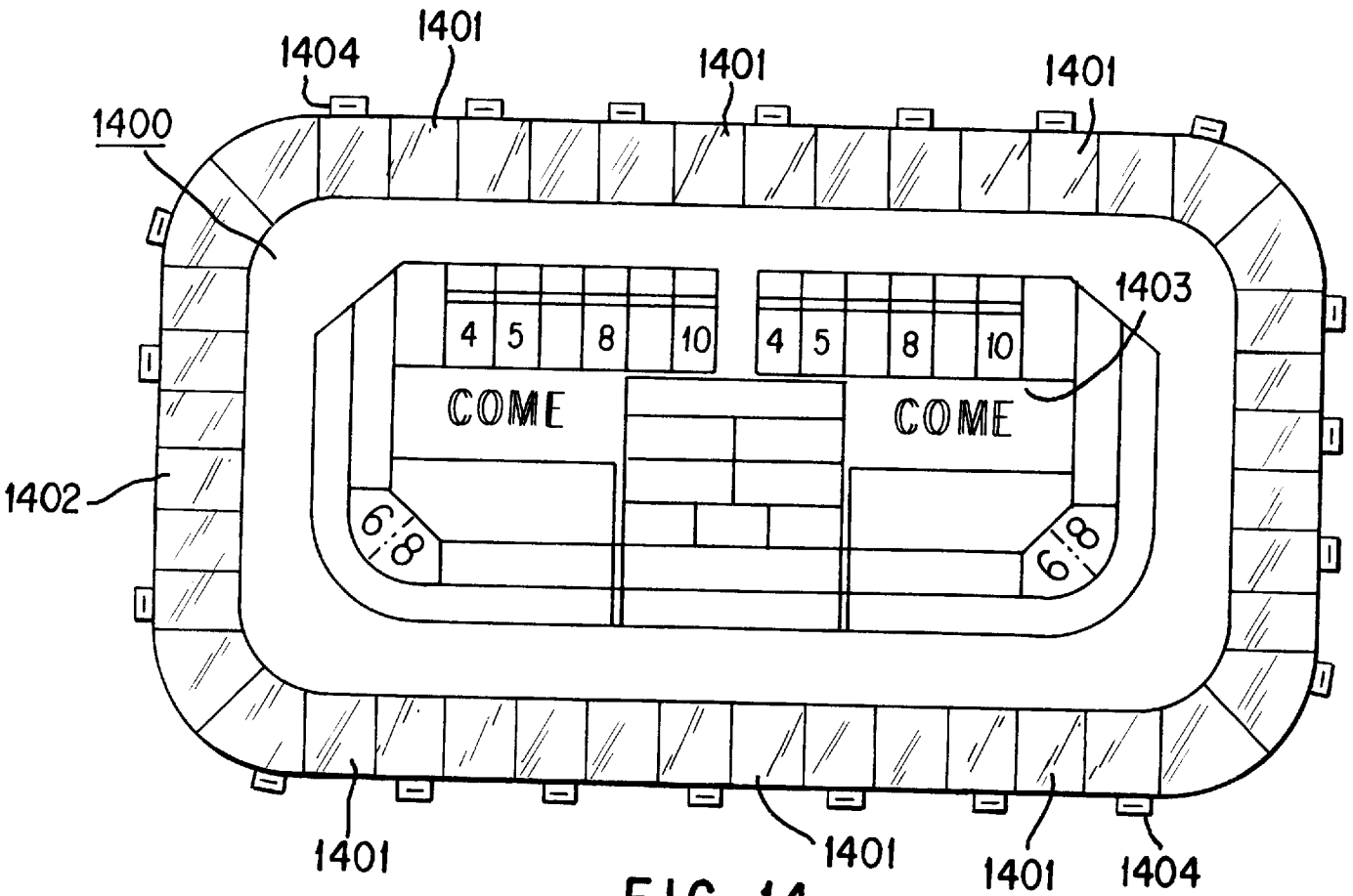
FIG. 14 depicts an automated craps table for use in the casino operating system of the present invention including individual player consoles and a dealer console.

As shown in FIG. 14, a craps table 1400 for use in the casino operating system of the present invention includes player consoles 1401 with card readers 1404 and a house console 1402.

The final position of dice rolled in the craps game is detected in a number of different ways. In one embodiment, sensors are provided above the table to read the dots on the top face of the two dice. In an alternative embodiment, the dice are provided with internal integrated circuit chips or magnetic memory elements which indicate to an appropriate sensor in the table the position in which the dice land. This detection method has the additional benefit of ensuring that the dice used in the game are the dice owned by the casino and not a player's substitution. In yet another embodiment, the dealer simply enters into the dealer console the dice pattern rolled in the game.

Several of the possible embodiments of the craps game according to the open architecture casino operating system of the present invention will now be described with reference to FIGS. 14 and 15.

With reference to FIG. 14, one embodiment of the craps game includes a betting marker (not shown), for example, a light pen or betting wand, which contains a integrated chip indicating the identity of the player and transmitting signals addressed to its corresponding player console 1401. One betting marker is linked to each individual player console 1401 either by physical means, such as a cable, or through transmitted communications, such as radio frequency data. Players use the betting markers to read betting positions on the craps betting table 1403. In this way, players place bets on positions on the betting table 1403. One possible type of betting marker includes an LED on the end of the wand that signals a sensor in the table the position desired by the player. In this type of apparatus, the betting marker may also indicate to the sensor on the table which player is placing the bet. The betting marker may include an indicator light to indicate to the player that the marker has been correctly sensed by the table sensor or that the marker has correctly sensed the betting position on the table. The betting table 1403 includes table sensors (for 1420, 1421, 1422, 1423, 1450, 1451, 1452, and 1453) positioned within the surface of the betting table 1403 at each possible betting position.

In alternative embodiment of the craps table for use in the open architecture casino operating system of the present invention, the individual player consoles 1401 include a small version of the entire betting table on the console screen, very similar to the roulette betting table 1303 shown on the console 1300 in FIG. 13. In this embodiment, players use a touch screen, for example, to indicate the positions on the table where they wish to place bets. Players indicate the amount of each bet and each position by using the touch screen features provided on the individual player console 1401, for example, by using numeric keypad similar to the numeric keypad 1304 shown in FIG. 13. The individual player console 1401 is capable of all functions described above with respect to slot machines and FIG. 6.

In an alternative embodiment, instead of a touch screen, a drawing of the betting table 1403 is provided on the individual player console 1401 with buttons in the different betting positions. In this embodiment, the player places bets by hitting the button marking the chosen position on the betting table.

Figure 17:
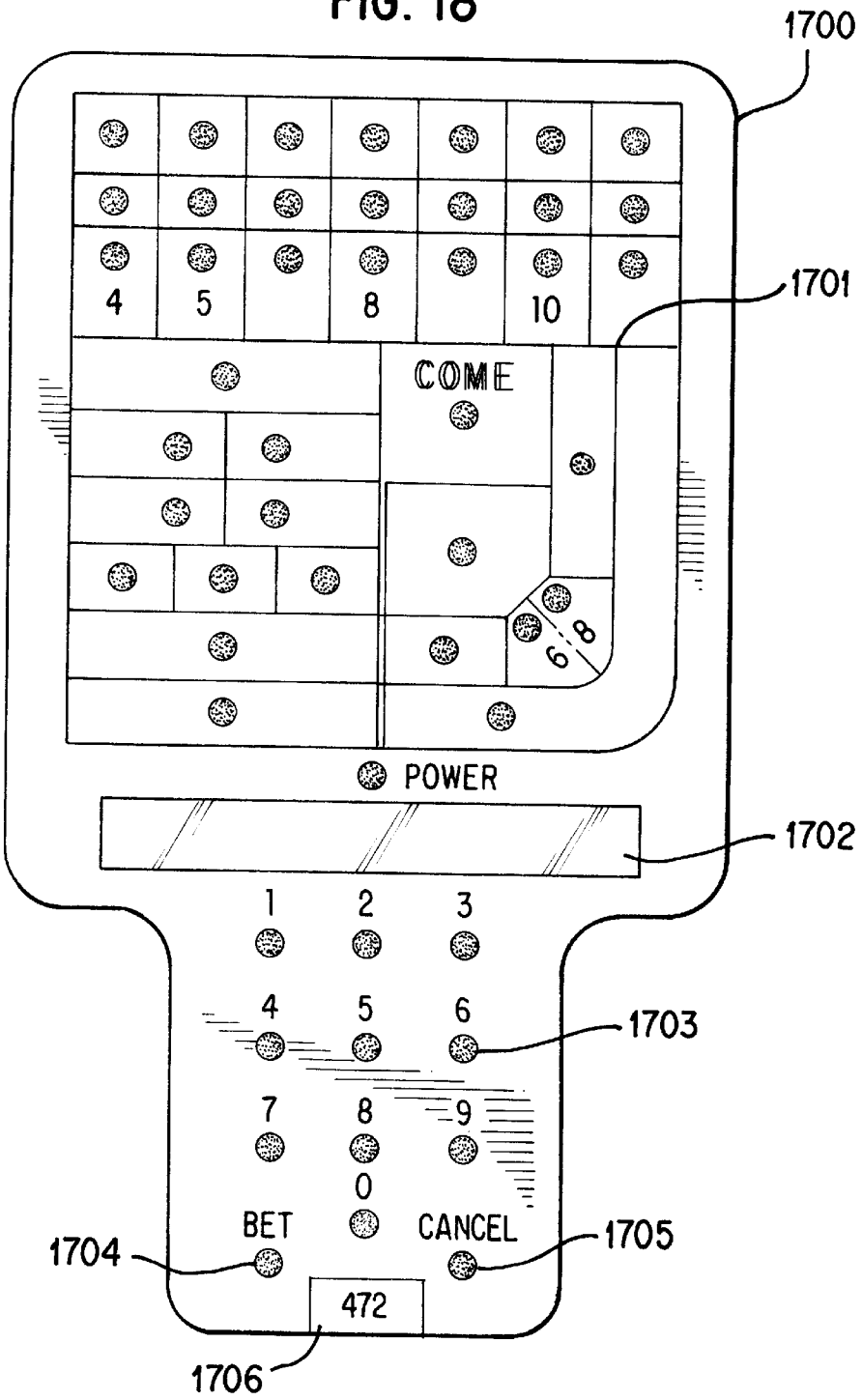
FIG. 17 depicts a remote system access terminal (RSAT) for placing bets at a craps table at a distance from the table, for example, when all of the player consoles at the table are being used by other players.

With reference to FIGS. 14 and 17, in an alternative embodiment of the craps game according to the open architecture casino operating system of the present invention, players who want to play at a particular craps table but are unable to gain access to one of the individual player consoles 1401 may obtain a two-way remote system access terminal (RSAT), a remote betting console as shown in FIG. 17.

The RSAT 1700 is a portable two-way controller which transmits information to a selected individual game computer and receives information from the selected individual game computer. The RSAT includes at least a receiving means, for example, a radio frequency receiver; a transmitting means, for example, a radio frequency transmitter; a processor including a central processing unit, a random access memory, and a read only memory; a input means, such as a keyboard, push buttons, or a touch sensitive multi-function user input; and a display means, for example, a liquid crystal display, an LED display, a braille reader, or a CRT device.

With reference to FIG. 17, a player obtains an RSAT 1700 by inserting a betting card 401 into a tabulator holder (not shown) to release the RSAT 1700. When the player inserts a betting card 401 into an RSAT holder, the RSAT 1700 downloads player information including credit balance information from the betting card 401 into the random access memory. Once the RSAT 1700 has downloaded the player information from the betting card 401, the RSAT holder releases the RSAT 1700 which is portable and can be carried around the casino by the player. The player's betting card 401 remains in the RSAT holder until the RSAT 1700 is returned to the RSAT holder. Once the player has returned the RSAT 1700 to the RSAT holder, winnings and losses information from the RSAT 1700 generated during the player's use of the RSAT 1700 is downloaded from the RSAT 1700 into the betting card 401. Once downloading is complete, the betting card 401 is released from the RSAT holder.

The RSAT holders may be located at the periphery of the craps table adjacent to the player consoles 1401, at the casino cashier booth, at the operator's station 1402, or in any other convenient location in the casino. The RSATs 1700 are either assigned a table number corresponding to one craps table in the casino, or the RSATs 1700 are provided with a selection means, such as a selection key or a scanner to read a table number, such that the player using the RSAT is in contact with the individual game computer corresponding to the table on which the player wishes to place bets.

The RSATs 1700 communicate with the individual game computer monitoring the game on which the remote player is betting. The RSAT 1700 transmits player identification information and betting information to the individual game computer (not shown) within the craps table. Once play of the game is completed, the individual game computer transmits winning and loss information to the RSAT 1700. The individual game computer also transmits the winning and losses information to the central computer 200 along with the player identification information from the RSAT 1700. In this way, the central computer 200 maintains an accurate record of the credit balance of the player. In systems in which only a central computer 200 is used to monitor gaming activities instead of individual game computers, the RSAT 1700 communicates with the central computer 200 directly.

As discussed above, when the player returns the RSAT 1700 to the RSAT holder and retrieves the betting card 401, the RSAT updates the betting card credit balance and releases the betting card 401 to the player.

Communications between the RSAT 1700 and the individual game computers can be preferably accomplished using radio frequency transmissions. However, infrared, ultrasonic, and other types of known communication may also be used.

In one embodiment of the RSAT 1700 illustrated in FIG. 17, a player uses numeric keypad 1703 and bet button 1704 to send a bet to a selected table. An optional table number 1706 may be assigned to the RSAT 1700 or a table button (not shown) is used to select that table on which the player wishes to place bets. The player enters the position of the desired bets using the buttons in betting area 1701. A display screen 1702 displays information to the player, and a power button is provided to enable the player to shut off the RSAT 1700, for example, while the player is watching play at a number of tables to determine where to play. A cancel button 1705 is also provided.

The craps table for use in the open architecture casino operating system of the present invention may also be configured to accommodate the use of betting chips, such as smart betting chips 1800.

Any number of variations of the arrangement of features of the embodiments described above are possible depending upon the needs of the casino, limited only by the required functions of the individual player consoles 1401, the RSATs 1700, the dealer console 1402, the individual game computer (not shown) within the gaming apparatus, and the gaming apparatus 1400. The position and arrangement of each of the components can vary according to the requirements and designs of the casino.

The RSATs 1600 and 1700 may also be altered to be compatible with other types of betting games to enable players to make "over-the-shoulder" bets at a crowded game. The RSATs may also be modified to enable a player access other types of games, electronic menus, sporting events and any other console features discussed above with reference to FIG. 6 and the slot machine player consoles 502.

The casino operating system described above can clearly save casino owners a large amount of money both in employee salaries and in surveillance and security costs. The number of employees required to actually run the games is decreased and the number of people required to survey the games to prevent cheating and theft is also decreased. Further, an accounting of the monetary transactions that take place in gambling is produced. The central computer 200 can be programmed to provide an accounting of transactions, for example, to the Internal Revenue Service, to accounting firms, state regulators, or any entity requiring this type of information via remote link 207. The central computer can also be programmed to automatically deduct from player winnings an amount representing the tax owed on the winnings.

The casino operating system of the present invention also provides computerized statistical data about player behavior in the casino through the use of the betting cards via central computer 200. Casinos can determine which machines are most popular, the average bets placed in the various games, the most popular times to gamble, and other information that is useful in assessing the efficiency and profitability of the casinos. Further, casinos are able to determine at any time how much money they have taken in during a specified period of time. This information is available on demand from the central computer and continuously updated.

The above casino operating system provides a unique combination of computerized gambling services with actual play. The activities that go on in the game are preserved but dealer discretion is largely removed. The system provides an ideal combination of computerized monitoring of funds and actual playing of games (instead of computer simulations).

A further benefit of the present system is its ability to simultaneously offer multiple gambling games to players. For example, players playing at a poker table can also play video gambling games or network games, such as keno or bingo, or bet on remote sporting events, such as horse races, via remote link 209 as they are playing poker. This feature of the casino operating system will further increase profitability of casinos because players can play more games, and, more importantly, place more bets in a given period of time.

While the present invention has been particularly described with reference to the preferred embodiments, it should be readily apparent to those of ordinary skill in the art that changes and modifications in form and details may be made without departing from the spirit and scope of the invention. It is intended that the appended claims include such changes and modifications.

I claim:

1. A casino operating system for enabling at least one player to gamble against a representative of a casino comprising:

at least one computerized player console for enabling a player to monitor a gambling game, to enter commands necessary to play the gambling game, and to place bets, wherein said computerized player console is activated upon insertion into said computerized player console of a betting card on which at least player identification and cash balance data are stored, said computerized player console displaying the cash balance data of the player, game information and command data, and winnings and losses data of the player, and updating said data stored on the betting card;

a dealer console for enabling a dealer to monitor the gambling game, and to enter commands necessary to play the gambling game, said dealer console being interconnected with said computerized player console; and a gaming apparatus for playing the gambling game interconnected with said at least one computerized player console and said dealer console, said gaming apparatus including encoded game pieces and encoded game chips and sensors that automatically generate play data of the gambling game, said gaming apparatus transmitting said play data to said computerized player console said computerized player console displaying said game information and said winnings and losses data of the player and automatically updating said cash balance data stored on said betting card in response to said play data.

2. The casino operating system according to claim 1, wherein said at least one computerized player console includes means for receiving said betting card provided by the player, wherein said betting card stores at least player data and player credit balance data, means for generating approval or denial data based on stored financial transaction data in said computerized player console indicating whether the value of said player credit balance data is sufficient to play the gambling game, means for receiving commands from the player enabling the player to play the gambling game, means for displaying player betting data entered by the player and said play data generated by said gaming apparatus, and means for generating said winnings and losses data based on said play data received from said gaming apparatus and said player betting data.

3. A casino operating system for monitoring play and controlling the flow of funds in a casino, said casino operating system comprising:

a central computer for receiving, storing and supplying financial transaction data for the casino;

at least one individual game computer coupled to said central computer for supplying said financial transaction data resulting from a gambling game to said central computer and receiving said financial transaction data from said central computer;

at least one player console coupled to said individual game computer for enabling a player to play a gambling game, wherein said individual player console includes means for receiving a betting card provided by the player, wherein said betting card stores at least player data and player credit balance data, means for transmitting the player data stored on the betting card to said individual game computer, means for receiving approval or denial data from said individual game computer based on stored financial transaction data in said central computer indicating whether the value of said player credit balance data is sufficient to play the gambling game, means for receiving commands from the player enabling the player to play the gambling game, means for displaying game data, player betting data, and player winnings and losses data to the player related to the gambling game to be played by the player, and means for providing said player betting data to said individual game computer;

a dealer console coupled to said individual game computer for enabling a dealer to play the gambling game and to provide credit to players, wherein said dealer console includes means for displaying said game data, said player betting data, and said player winnings and losses data to the dealer, means for receiving commands from the dealer enabling the dealer to play the gambling game, and means for adjusting said player credit balance data stored on the betting card provided by the player; and a gaming apparatus for generating said game data and said player betting data, said gaming apparatus including encoded gaming pieces and encoded gaming chips for use in playing the gambling game, sensor means for identifying said encoded gaming pieces and encoded gaming chips and transmitting said game data and said player betting data to said individual game computer, said individual game computer providing said game data, said player betting data and said player winnings and losses data to said player console and said dealer console, and further providing said winnings and losses data to said central computer to update said stored financial transaction data, wherein said player console automatically updates said player credit balance data stored on said betting card in response to said game data, said player betting data, and said player winnings and losses data.

4. A casino operating system for monitoring play and controlling the flow of funds in a casino, said casino operating system comprising:

at least one individual game computer for receiving, storing, and providing financial transaction data;

at least one player console coupled to said individual game computer for enabling a player to play a gambling game, wherein said individual player console includes means for receiving a betting card provided by the player, wherein said betting card stores at least player data and player credit balance data, means for transmitting the player data contained on the betting card to the individual game computer, means for receiving approval or denial data from said individual game computer based on stored financial transaction data in said individual game computer indicating whether the value of the player credit balance data is sufficient to play the gambling game, means for receiving commands from the player enabling the player to play the gambling game, means for displaying game data, player betting data, and player winnings and losses data to the player related to the gambling game to be played by the player, and means for providing said player betting data to said individual game computer;

a dealer console coupled to said individual game computer for enabling a dealer to play the gambling game and to provide credit to players, wherein said dealer console includes means for displaying said game data, said player betting data, and said player winnings and losses data to the dealer, means for receiving commands from the dealer enabling the dealer to play the gambling game, and means for adjusting player credit balance data stored on the betting card provided by the player; and a gaming apparatus for generating said game data and said player betting data, said gaming apparatus including playing cards having a suit and a face value with encoded identification markings indicating said suit and said face value of each of said playing cards, first holding means for holding said playing cards wherein said playing cards are dealt from said holding means to the player and to the dealer, said holding means including sensing means for reading said encoded identification data on each of said playing cards dealt to the player and the dealer, and for providing said game data to said individual game computer, a plurality of encoded betting chips for placing bets, second holding means for holding the encoded betting chips bet during play of said gambling game, and chip value sensing means for sensing a value of the encoded betting chips bet during play of said gambling game and transmitting said player betting data to said individual game computer, wherein said individual game computer provides said game data, said player betting data and said player winnings and losses data to said player console and said dealer console and updates said stored financial transaction data stored in said individual game computer, and wherein said player console automatically updates said player credit balance data stored on said betting card in response to said game data, said player betting data and said winnings and losses data.

5. The casino operating system according to claim 4, further comprising a central computer for receiving, storing and providing financial transaction data concerning monetary transactions in the casino, wherein said central computer keeps a current record of all financial transactions taking place in the casino.

6. The casino operating system according to claim 4, wherein said player console further enables the player to play remote gambling games or to view and place bets on remote sporting events provided by a remote network system to said player console via said individual game computer.

7. The casino operating system according to claim 4, wherein said player console further enables the player to play computer-generated games generated and displayed by said player console.

8. The casino operating system according to claim 4, wherein said gaming apparatus further includes collecting means for collecting the encoded betting chips bet during play of said gambling game, and distributing means for distributing winnings to the player based on the value sensed by said chip value sensing means and said player winnings and losses data generated by said individual game computer.

9. The casino operating system according to claim 8, wherein said distributing means comprises a slot machine including a recessed tray for receiving the encoded betting chips distributed by said slot machine.

10. The casino operating system according to claim 4, wherein said gaming apparatus further comprises a plurality of encoded betting chips for placing bets, and a gaming table including a central recessed area in the gaming table for receiving said encoded betting chips, and mechanical receiving means for receiving player deposits of said encoded betting chips to be bet such that said encoded betting chips are deposited into said mechanical receiving means and fall into said central recessed area, said mechanical receiving means containing scanning means for scanning the encoded betting chips inserted into said mechanical receiving means in order to determine a value of the encoded betting chips, said scanning means transmitting betting data indicating the scanned value of the encoded betting chips to said individual game computer, said individual game computer monitoring betting activity, transmitting said betting data to said player console for display, and calculating and transmitting a value of house percentage data representing a house percentage amount.

11. The casino operating system according to claim 10, wherein said gaming apparatus further includes distributing means for distributing winnings to the player based on the value scanned by said scanning means and said player winnings and losses data generated by said individual game computer.

12. The casino operating system according to claim 11, wherein said distributing means comprises a slot machine located within said gaming table including a recessed tray positioned at each player position on said gaming table for receiving the encoded betting chips distributed by said slot machine.

13. The casino operating system according to claim 4, wherein said means for receiving said betting card provided by the player includes a delay means for delaying release of said betting card from said means for receiving said betting card for a predetermined period of time.

14. A casino operating system for monitoring play and controlling the flow of funds in a casino, said casino operating system comprising:

at least one individual game computer for receiving, storing, and providing financial transaction data;

at least one player console coupled to said individual game computer for enabling a player to play a gambling game, wherein said individual player console includes means for receiving a betting card provided by the player, wherein said betting card stores at least player data and player credit balance data, means for transmitting the player data contained on the betting card to the individual game computer, means for receiving approval or denial data from said individual game computer based on stored financial transaction data in said individual game computer indicating whether the value of the player credit balance data is sufficient to play the gambling game, means for receiving commands from the player enabling the player to place bets, means for displaying game data, player betting data, and player winnings and losses data to the player related to the gambling game to be played by the players, and means for updating said player credit balance data in response to said player winnings and losses data;

a dealer console coupled to said individual game computer for enabling a dealer to play the gambling game and to provide credit to players, wherein said dealer console includes means for displaying said game data, said player betting data, and said player winnings and losses data to the dealer, and means for adjusting the player credit balance data stored on the betting card provided by the player; and a gaming apparatus for generating said game data and said player betting data, said gaming apparatus comprising a plurality of encoded betting chips for placing bets, and a gaming table including a central recessed area in the gaming table for receiving said encoded betting chips, and at least one sloped chute for receiving player deposits of said encoded betting chips to be bet such that said encoded betting chips are deposited into one end of said sloped chute and fall through said sloped chute into said central recessed area, said sloped chute containing scanning means for scanning the encoded betting chips inserted into said sloped chute as the encoded betting chips slide through said sloped chute in order to determine a value of the encoded betting chips, said scanning means transmitting said player betting data indicating the scanned value of the encoded betting chips to said individual game computer, said individual game computer monitoring betting activity, transmitting said player betting data and said winnings and losses data to said player console for display, and calculating and transmitting a value of house percentage data representing a house percentage amount.

15. The casino operating system according to claim 14, wherein said gaming apparatus further includes distributing means for distributing winnings to the player based on the value sensed by said chip value sensing means and said player winnings and losses data generated by said individual game computer.

16. The casino operating system according to claim 15, wherein said distributing means comprises a slot machine located within said gaming table including a recessed tray positioned at each player position on said gaming table for receiving the encoded betting chips distributed by said slot machine.

17. The casino operating system according to claim 14, further comprising a central computer for receiving, storing and providing financial transaction data concerning monetary transactions in the casino, wherein said central computer keeps a current record of all financial transactions taking place in the casino.

18. The casino operating system according to claim 14, wherein said player console further enables the player to play remote gambling games or to view and place bets on remote sporting events provided by a remote network system to said player console via said individual game computer.

19. The casino operating system according to claim 14, wherein said player console further enables the player to play computer-generated games generated and displayed by said player console.

20. The casino operating system according to claim 14, wherein said means for receiving said betting card provided by the player includes a delay means for delaying release of said betting card from said means for receiving said betting card for a predetermined period of time.

21. A casino operating system for monitoring play and controlling the flow of funds in a casino, said casino operating system comprising:

at least one individual game computer for receiving, storing, and providing financial transaction data;

at least one player console coupled to said individual game computer for enabling a player to play a gambling game, wherein said individual player console includes means for receiving a betting card provided by the player, wherein said betting card stores at least player data and player credit balance data, means for transmitting the player data contained on the betting card to the individual game computer, means for receiving approval or denial data from said individual game computer based on stored financial transaction data in said individual game computer indicating whether the value of said player credit balance data is sufficient to play the gambling game, means for receiving commands from the player enabling the player to play the gambling game, means for displaying game data, player betting data, and player winnings and losses data to the player related to the gambling game to be played by the player, and means for providing said player betting data to said individual game computer;

a dealer console coupled to said individual game computer for enabling a dealer to play the gambling game and to provide credit to players, wherein said dealer console includes means for displaying said game data, said player betting data, and said player winnings and losses data to the dealer, means for receiving commands from the dealer enabling the dealer to play the gambling game, and means for providing credit to the betting card provided by the player; and a gaming apparatus for generating said game data, said gaming apparatus comprising a roulette ball, a roulette betting table, and a roulette wheel adapted to permit said roulette ball to circle, wherein first sensing means are provided at least one position on said roulette wheel for detecting a final resting position of said roulette ball, such that said first sensing means provides said game data indicating said final resting position of said roulette ball to said individual game computer, said individual game computer providing said game data to said dealer console and to said player console, and second sensing means are positioned on said roulette wheel for sensing circling speed of said roulette ball and for providing said circling speed to said individual game computer which compares said circling speed with a pre-set speed value, such that if said pre-set speed value is less that said circling speed, said individual game computer provides data to said dealer console and said player console that betting is closed.

22. The casino operating system according to claim 21, further comprising a central computer for receiving, storing and providing financial transaction data concerning monetary transactions in the casino, wherein said central computer keeps a current record of all financial transactions taking place in the casino.

23. The casino operating system according to claim 21, wherein said player console further enables the player to play remote gambling games or to view and place bets on remote sporting events provided by a remote network system to said player console via said individual game computer.

24. The casino operating system according to claim 21, wherein said player console further enables the player to play computer-generated games generated and displayed by said player console.

25. The casino operating system according to claim 21, wherein said means for receiving said betting card provided by the player includes a delay means for delaying release of said betting card from said means for receiving said betting card for a predetermined period of time.

26. The casino operating system according to claim 21, wherein said gaming apparatus further comprises a third sensing means for detecting rotational speed of said roulette wheel.

27. The casino operating system according to claim 21, wherein said circling speed of said roulette ball is transmitted from said individual game computer to said player console and displayed on said player console to indicate an approximate amount of time left before betting will be closed.

28. The casino operating system according to claim 21, wherein said circling speed of said roulette ball is transmitted from said individual game computer to said dealer console and displayed on said dealer console to indicate an approximate amount of time left before betting will be closed.

29. The casino operating system according to claim 21, wherein said player console displays a miniaturized image of said roulette betting table, wherein the player places a bet by entering a bet amount on said player console and touching a position on said miniaturized image to indicate a desired betting position of the player.

30. The casino operating system according to claim 21, wherein said player console includes a betting marker wherein the player places a bet by entering a bet amount into said player console and touching a position on said roulette betting table with said betting marker to indicate a desired betting position of the player, and wherein said roulette betting table is provided with sensing means at possible betting positions on said roulette betting table for sensing proximity of said betting marker.

31. A casino operating system for monitoring play and controlling the flow of funds in a casino, said casino operating system comprising:

at least one individual game computer for receiving, storing, and providing financial transaction data;

at least one player console coupled to said individual game computer for enabling a player to play a gambling game, wherein said individual player console includes means for receiving a betting card provided by the player, wherein said betting card stores at least player data and player credit balance data, means for transmitting the player data contained on the betting card to the individual game computer, means for receiving approval or denial data from said individual game computer based on stored financial transaction data in said individual game computer indicating whether the value of said player credit balance data is sufficient to play the gambling game, means for receiving commands from the player enabling the player to play the gambling game, means for displaying game data, player betting data, and player winnings and losses data to the player related to the gambling game to be played by the player, and means for providing said player betting data to said individual game computer;

a dealer console coupled to said individual game computer for enabling a dealer to play the gambling game and to provide credit to players, wherein said dealer console includes means for displaying said game data, said player betting data, and said player winnings and losses data to the dealer, and means for providing credit to the betting card provided by the player; and a gaming apparatus for generating said game data, said gaming apparatus comprising a pair of dice provided with indicating means for indicating a final resting position of each of said pair of dice, and a craps table onto which said pair of dice are thrown, said craps table having sensing means for reading position data from said indicating means indicating the final resting position of each of said pair of dice, wherein said sensing means generates and transmits said game data to said individual game computer, said individual game computer providing said game data to said player console and to said dealer console.

32. The casino operating system according to claim 31, further comprising a central computer for receiving, storing and providing financial transaction data concerning monetary transactions in the casino, wherein said central computer keeps a current record of all financial transactions taking place in the casino.

33. The casino operating system according to claim 31, wherein said player console further enables the player to play remote gambling games or to view and place bets on remote sporting events provided by a remote network system to said player console via said individual game computer.

34. The casino operating system according to claim 31, wherein said player console further enables the player to play computer-generated games generated and displayed by said player console.

35. The casino operating system according to claim 31, wherein said means for receiving said betting card provided by the player includes a delay means for delaying release of said betting card from said means for receiving said betting card for a predetermined period of time.

36. In a casino operating system for monitoring play and controlling the flow of funds in a casino, said casino operating system comprising a gaming apparatus for generating game data and player betting data including encoded game pieces and encoded game chips and sensors and at least one individual game computer coupled to said gaming apparatus for monitoring play of said gambling game and receiving, storing, and providing financial transaction data, the play of said gambling game being automatically entered into said individual game computer by said sensors enabling said individual game computer to monitor the gambling game and calculate corresponding player winnings and losses data:

at least one player console coupled to said individual game computer for enabling a player to play a gambling game, wherein said individual player console includes means for receiving a betting card provided by the player, wherein said betting card stores player data and player credit balance data, means for transmitting the player data contained on the betting card to the individual game computer, means for receiving approval or denial data from said individual game computer based on stored financial transaction data indicating whether the value of said player credit balance data is sufficient to play the gambling game, means for receiving commands from the player enabling the player to play the gambling game and place bets, and means for displaying said game data, said player betting data, and said player winnings and losses data to the player related to the gambling game to be played by the player and automatically updating said player credit balance data stored on said betting card.

37. The casino operating system according to claim 36, wherein said player console further enables the player to play remote gambling games or to view and place bets on remote sporting events provided by a remote network system to said player console via said individual game computer.

38. The casino operating system according to claim 36, wherein said player console further enables the player to play computer-generated games generated and displayed by said player console.

39. The casino operating system according to claim 36, further comprising a central computer for receiving, storing and providing financial transaction data concerning monetary transactions in the casino, wherein said central computer keeps a current record of all financial transactions taking place in the casino and monitors activity of said at least one individual game computer.

40. The casino operating system according to claim 39, wherein said player console further enables the player to access a menu of food and beverage items available from a casino kitchen and to place orders such that an order entered into said player console by the player is transmitted by said player console to said central computer via said individual game computer for delivery to said casino kitchen.

41. The casino operating system according to claim 39, wherein said player console further notifies the player when the player wins a door prize randomly awarded by said central computer.

42. The casino operating system according to claim 39, wherein said player console further enables the player to call for waitress service or telephone service by entering a service command such that said service command is transmitted by said player console to said central computer via said individual game computer for delivery to a service department.

43. The casino operating system according to claim 36, wherein said player console further displays sporting event information provided by a remote network system to said player console via said individual game computer and enables the player to place bets based on said displayed sporting event information.

44. The casino operating system according to claim 36, wherein said player console further displays off-track betting information provided by a remote network system to said player console via said individual game computer and enables the player to place off-track bets via said remote network.

45. The casino operating system according to claim 36, wherein said player console further comprises a display screen and command buttons permitting the player to view and place bets on other gambling games being played at other locations in the casino.

46. The casino operating system according to claim 36, wherein said player console further enables the player to choose a language in which said player console will display said game data, said player betting data, and said player winnings and losses data.

47. In a casino operating system for monitoring play and controlling the flow of funds in a casino comprising at least one gaming apparatus for playing a gambling game comprising encoded parts and sensors that automatically generate play data of the gambling game and processing means to generate winnings and losses data based on betting data input by the player:

a remote system access terminal (RSAT) which enables the player to enter commands necessary to place bets on the gambling game, wherein said RSAT is activated upon insertion into an RSAT holder of a betting card on which at least player identification and cash balance data are stored, said RSAT storing the cash balance data of the player, transmitting betting date entered by the player to said gaming apparatus, and receiving and storing winnings and losses data of the player generated by said gaming apparatus and transmitted by said gaming apparatus to said RSAT.

48. The casino operating system according to claim 47, wherein said RSAT further enables the player to enter play commands to play the gambling game monitored by said gaming apparatus, said play data transmitted to said RSAT to enable the player to play said gambling game.

49. The casino operating system according to claim 47, further comprising:

at least one computerized player console adapted to permit a player to monitor a gambling game, to enter commands necessary to play the gambling game, and to place bets, wherein said computerized player console is activated upon insertion into said computerized player console of a betting card on which at least player identification and cash balance data are stored, said computerized player console displaying the cash balance data of the player, game information and command data, and winnings and losses data of the player, and updating said data stored on the betting card; and a dealer console adapted to permit a dealer to monitor the gambling game, to enter commands necessary to play the gambling game, and to place bets, said dealer console further adapted to be interconnected with said computerized player console;

said gaming apparatus transmitting said play data to said computerized player console and to said RSAT.

50. In a casino operating system for monitoring play and controlling the flow of funds in a casino comprising a gaming apparatus for playing a gambling game including encoded parts and sensors that automatically generate play data of the gambling game:

a smart betting chip comprising an integrated circuit chip, wherein said integrated circuit chip transmits identification information indicating at least a value for the smart betting chip; and sensing means for receiving said identification information transmitted by said integrated circuit within said smart betting chip, wherein said sensing means transmits said identification and value to said gaming apparatus to be used in generating said play data.

* * * * *

UNITED STATES PATENT AND TRADEMARK OFFICE

CERTIFICATE OF CORRECTION

PATENT NO. : 5,770,533
DATED : January 23, 1998
INVENTOR(S) : John Franco Franchi It is certified that error appears in the above-identified patent and that said Letters Patent is hereby corrected as shown below:

Title page,
Item [56], References Cited, please insert the following U.S. PATENT DOCUMENTS and OTHER PUBLICATIONS:

| | | | | |
|---|---|---|---|---|
| -- | 3,731,936 | 5/1973 | Copeland | 273/149 P |
| | 3,810,627 | 5/1974 | Levy | 273/138 A |
| | 3,909,002 | 9/1975 | Levy | 273/138 A |
| | 4,373,726 | 2/1983 | Churchill et al | 273/138 A |
| | 4,378,940 | 4/1983 | Gluz et at | 273/237 |
| | 4,531,187 | 7/1985 | Uhland | 364/412 |
| | 4,575,622 | 3/1986 | Pellegrini | 235/382 |
| | 4,662,637 | 5/1987 | Pfeiffer | 273/149 P |
| | 4,667,959 | 5/1987 | Pfeiffer et al | 273/149 R |
| | 4,760,527 | 7/1988 | Sidley | 364/412 |
| | 4,856,787 | 8/1989 | Itkis | 273/237 |
| | 4,926,327 | 5/1990 | Sidley | 364/412 |
| | 5,038,022 | 8/1991 | Lucero | 235/380 |
| | 5,110,134 | 5/1992 | Laughlin et al | 273/293 |
| | 5,179,517 | 1/1993 | Sarbin et al | 364/410 |
| | 5,219,172 | 6/1993 | Laughlin et al | 273/304 |
| | 5,224,712 | 7/1993 | Laughlin et al | 273/304 |

Gamblers General Store Catalog, January 1994, pp. 2-4,15, 26
"Las Vegas, U.S.A.," Kurt Andersen, Time, January 10, 1994, pp. 42-51
"America's Gambling Craze", James Popkin & Katia Hetter, U.S. News & World Report, March 14, 1994, pp.42-43, 46 --

Signed and Sealed this

Twenty-first Day of September, 2004

JON W. DUDAS
*Director of the United States Patent and Trademark Office*